US008646898B2

(12) United States Patent
Bitoh

(10) Patent No.: US 8,646,898 B2
(45) Date of Patent: Feb. 11, 2014

(54) NAIL PRINT APPARATUS

(75) Inventor: Hiroyasu Bitoh, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 97 days.

(21) Appl. No.: 13/315,624

(22) Filed: Dec. 9, 2011

(65) Prior Publication Data

US 2012/0147107 A1 Jun. 14, 2012

(30) Foreign Application Priority Data

Dec. 10, 2010 (JP) ..... 2010-275255

(51) Int. Cl.
*B41J 2/01* (2006.01)

(52) U.S. Cl.
USPC ..... 347/101; 132/73; 118/300

(58) Field of Classification Search
USPC ..... 347/101, 107; 118/300; 132/73, 73.5, 132/200; 358/1.2; 705/27.1
IPC ..... B41J 2/01
See application file for complete search history.

(56) References Cited

U.S. PATENT DOCUMENTS 5,915,078 A * 6/1999 Miyasaka et al. ..... 358/1.12
5,931,166 A * 8/1999 Weber et al. ..... 132/73
6,035,860 A * 3/2000 Mombourquette ..... 132/200
6,067,996 A * 5/2000 Weber et al. ..... 132/73
6,286,517 B1 * 9/2001 Weber et al. ..... 132/73
6,336,694 B1 * 1/2002 Ishizaka ..... 347/2
6,525,724 B1 * 2/2003 Takami ..... 345/419
2004/0194648 A1 * 10/2004 Uchida ..... 101/35
2005/0174367 A1 * 8/2005 Kondo et al. ..... 347/3
2007/0092634 A1 * 4/2007 Zhang ..... 427/1
2009/0153604 A1 * 6/2009 Chen et al. ..... 347/9

FOREIGN PATENT DOCUMENTS

JP 2003-534083 A 11/2003

* cited by examiner

*Primary Examiner* — Manish S Shah
*Assistant Examiner* — Roger W Pisha, II
(74) *Attorney, Agent, or Firm* — Holtz, Holtz, Goodman & Chick, PC

(57) ABSTRACT

Disclosed is a nail print apparatus including: a nail print apparatus including: a print finger inserting section to insert a finger with a nail to be printed as a print finger; a non-print finger inserting section to insert a finger on which printing is not performed as a non-print finger; a grabbing section which is provided between the print finger inserting section and the non-print finger inserting section and which can be pinched with the print finger and the non-print finger; and a printing section which performs printing on a nail of the print finger, wherein the grabbing section includes a first finger positioning section to position the four fingers when printing is performed by the printing section; and a second finger positioning section to position the thumb of the second hand when printing is performed by the printing section.

7 Claims, 15 Drawing Sheets

NAIL PRINT APPARATUS

BACKGROUND OF THE INVENTION

1. Field of the Invention

The present invention relates to a nail print apparatus.

2. Description of the Related Art

A nail print apparatus is a print apparatus where a finger with a nail on which printing is to be performed is positioned on a finger placement stage provided in the apparatus main body, and an image is printed on the nail of the positioned finger.

Most conventional nail print apparatuses performed printing by setting the finger one finger at a time in the apparatus. However, lately, nail print apparatuses are developed by enhancing fixing method of the finger, technique of identifying type of finger, etc. so that it is possible to print on a plurality of fingers at once as described in, for example, Japanese Unexamined Patent Application Publication (Translation of PCT Application) No. 2003-534083.

In order to be able to print on nails of a plurality of fingers as described above, it is necessary to provide a printing section so that nails of all fingers to be printed are included in the printable range of the printing section.

However, there is a difference in a length of a finger of a person, and especially the position of the nail is greatly different in the length direction of the finger between the thumb and the other four fingers (index finger to little finger).

Therefore, in order to be able to print on the nails of all fingers to be printed, the printable range of the printing section needs to be large. This leads to the problem of the printing section becoming large, and as a result, the entire nail print apparatus becomes larger, heavier and costly.

SUMMARY OF THE INVENTION

The present invention has been made in consideration of the above situation, and one of the main objects is to provide a nail print apparatus which can print on a plurality of nails aligned even if the plurality of nails have different lengths while realizing a smaller and lighter apparatus.

In order to achieve any one of the above advantages, according to an aspect of the present invention, there is provided a nail print apparatus including:

a print finger inserting section to insert a finger with a nail to be printed as a print finger;

a non-print finger inserting section to insert a finger on which printing is not performed as a non-print finger, the non-print finger inserting section provided in a position near the print finger inserting section;

a grabbing section which is provided between the print finger inserting section and the non-print finger inserting section and which can be pinched with the print finger inserted in the print finger inserting section and the non-print finger inserted in the non-print finger inserting section; and a printing section which performs printing on a nail of the print finger inserted in the print finger inserting section, wherein the grabbing section includes a first finger positioning section in which a base between four fingers from an index finger to a little finger of a first hand which is one hand inserted in the print finger inserting section and a thumb of the first hand inserted in the non-print finger inserting section comes into contact with a first edge section to position the four fingers when printing is performed by the printing section; and a second finger positioning section which includes a second edge section positioned in a position misaligned to a far side in an inserting direction of the print finger than the first edge section of the first finger positioning section, wherein a base between a thumb of a second hand which is the other hand inserted in the print finger inserting section and four fingers from an index finger to a little finger of the second hand inserted in the non-print finger inserting section comes into contact with the second edge section to position the thumb of the second hand when printing is performed by the printing section.

According to the present invention, the present invention includes a first finger positioning section which positions four fingers from an index finger to a little finger of a first hand which is one hand when printing is performed by a printing section and a second finger positioning section which positions a thumb of a second hand which is the other hand when printing is performed by the printing section, and a second edge section of the second finger positioning section is provided in a position misaligned in an inserting angle of the print finger than a first edge section of the first finger positioning section. Consequently, the position of the nail of the thumb and the four fingers from the index finger and the little finger, in which the position of the nail is misaligned greatly in a length direction of the finger, can be aligned in a substantially same position in the length direction of the finger. Therefore, the nail of the thumb and the nail of the four fingers can be printed in an aligned state. Moreover, there is no need to secure a large print area in order to print the nail of the thumb and the nail of the four fingers. Further, the printing section can be made smaller and lighter and therefore, the entire nail print apparatus can be realized smaller, lighter and with a lower cost.

BRIEF DESCRIPTION OF THE DRAWINGS

The present invention and the above-described objects, features and advantages thereof will become more fully understood from the following detailed description with the accompanying drawings and wherein.

DETAILED DESCRIPTION OF THE PREFERRED EMBODIMENTS

Preferred embodiments for carrying out the present embodiment are described in detail with reference to the attached drawings. However, the scope of the invention is not limited to the embodiments and the illustrated examples.

First Embodiment

First, a first embodiment of a nail print apparatus of the present invention is described with reference to FIG. 1 to FIG. 8.

Figure 1:
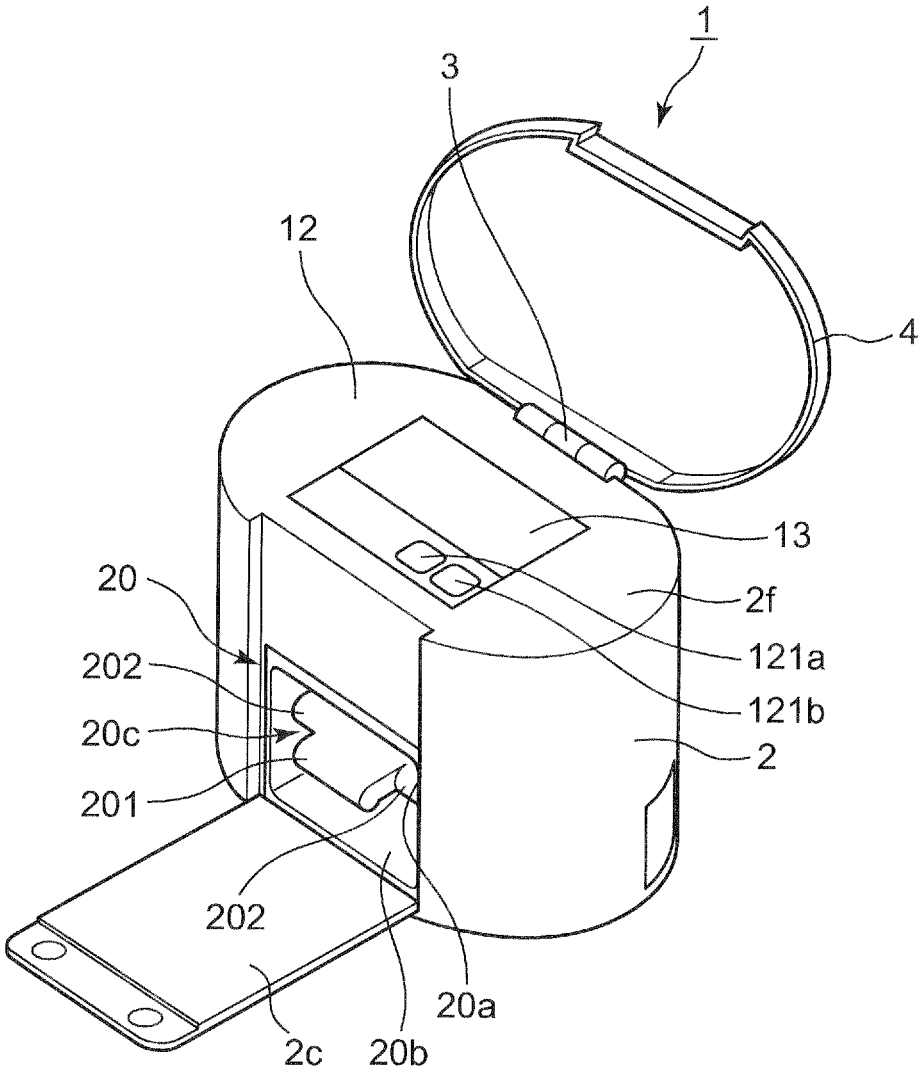
FIG. 1 is a conceptual perspective view of a first embodiment of a nail print apparatus of the present invention in a state where a cover is open.
Figure 2:
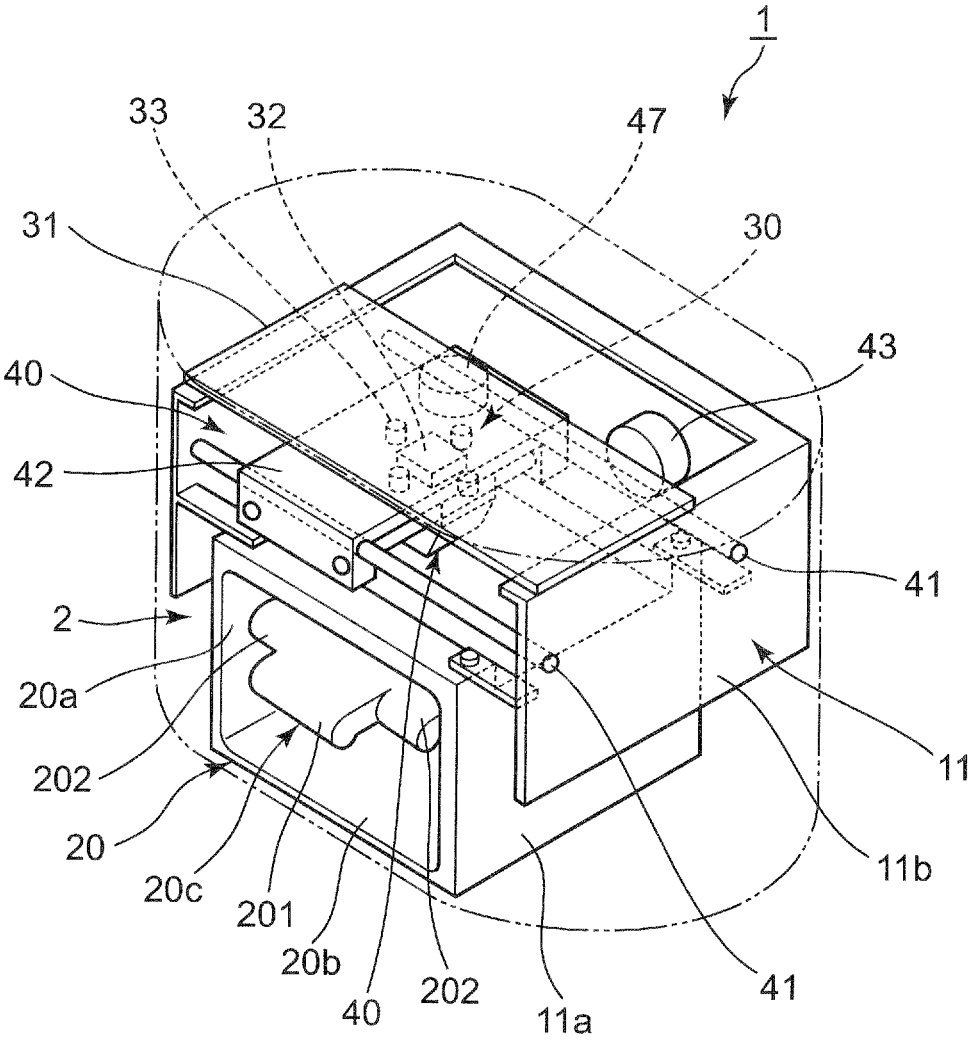
FIG. 2 is a conceptual perspective view of an apparatus main body of the nail print apparatus shown in FIG. 1.

FIG. 1 is a perspective view showing an outside appearance of a nail print apparatus of the present embodiment and FIG. 2 is a perspective view showing an inner configuration of the nail print apparatus.

As shown in FIG. 1, the nail print apparatus 1 includes a case main body 2 and a cover 4. The case main body 2 and the cover 4 are connected to each other through a hinge 3 provided in a rear edge section of the upper surface of the case main body 2.

The case main body 2 is formed in an oval shape from a planar view. An opening/closing plate 2*c* is provided so as to be able to fold up and down on a front side of the case main body 2. The opening/closing plate 2*c* is connected to the case main body 2 through a hinge (not shown) provided in a lower edge section of the front face of the case main body 2. The opening/closing plate 2*c* is for opening and closing the front face of the case main body 2.

A later described operation section 12 is provided on a center section of a top plate 2*f* of the case main body 2.

The shape and the configuration of the case main body 2 and the cover 4 is not limited to the example shown here.

The apparatus main body 10 of the nail print apparatus 1 is stored in the case main body 2. The apparatus main body 10 includes, a print finger fixing section 20 composing a print finger fixing section shown in FIG. 2, a photographing section 30 composing a photographing section, a printing section 40 composing a printing section and a controlling device 50 composing a controlling section (see FIG. 8). Among the above, the print finger fixing section 20, the photographing section 30, the printing section 40 and the controlling device 50 are provided in a device casing 11.

The device casing 11 is composed of a lower device casing 11*a* and an upper device casing 11*b*. The lower device casing 11*a* is formed in a box shape and is provided at the bottom of the inside of the case main body 2. The upper device casing 11*b* is provided above the lower device casing 11*a* and at the top of the inside of the case main body 2.

The print finger fixing section 20 is provided in the lower device casing 11*a* of the device casing 11. The print finger fixing section 20 is composed of the print finger inserting section 20*a*, a non-print finger inserting section 20*b* and a grabbing section 20*c* provided in the lower device casing 11*a*.

The print finger inserting section 20*a* is a finger inserting section to insert a finger (hereinafter referred to as "print finger") U1 corresponding to a nail T which is to be printed (see FIG. 4).

The non-print finger inserting section 20*b* is a finger inserting section for inserting a finger (hereinafter referred to as "non-print finger") U2 other than the print finger (see FIG. 4).

The grabbing section 20*c* is a portion which can be pinched with the print finger U1 inserted in the print finger inserting section 20*a* and the non-print finger U2 inserted in the non-print finger inserting section 20*b*. The grabbing section 20*c* is composed of a partition wall 21 dividing the print finger inserting section 20*a* and the non-print finger inserting section 20*b*.

The upper surface of the grabbing section 20*c* composes a flat print finger placing face. A bulging section 22 is formed at an edge section on the finger inserting side of the grabbing section 20*c*. The bulging section 22 is formed in a portion where the base U3 is in contact with the print finger U1 and the non-print finger U2 when the print finger U1 and the non-print finger U2 are deeply inserted in the print finger inserting section 20*a* and the non-print finger inserting section 20*b*. The bulging section 22 seen from a cross section along a finger inserting direction is a circle bulging downward from the bottom face of the grabbing section 20*c* so that the print finger U1 and the non-print finger U2 can strongly pinch the grabbing section 20*c* in a state where an entire pulp of the print finger U1 is in contact with the print finger placing face. The shape of the bulging section 22 is not limited to a circle cross section and can be a non-circle shape such as an oval cross section, a polygon shape cross section, etc.

As shown in FIG. 1 and FIG. 2, etc., according to the present embodiment, in the center section in the width direction of the grabbing section 20*c*, a first finger positioning section 201 is provided in which a base U3 between four fingers from an index finger to a little finger of a first hand which is one hand and which are print finger U1 inserted in the print finger inserting section 20*a* and a thumb of the first hand which is the one hand and which is the non-print finger U2 inserted in the non-print finger inserting section 20*b* comes into contact with a first edge section 201A. The first finger positioning section 201 positions the four fingers when printing is performed by the printing section 40 which is the printing section.

Figure 3A:
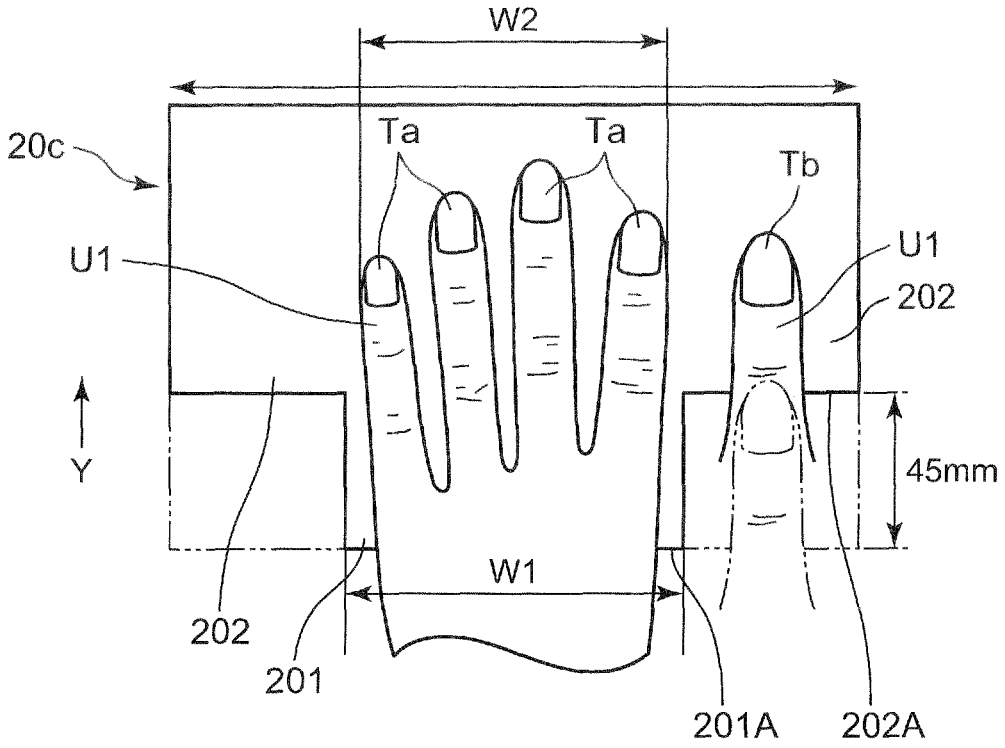
FIG. 3A is a planar view of a grabbing section of the first embodiment, in a state where an index finger to a little finger of a left hand are positioned by a first finger positioning section and a thumb of a right hand is positioned by a second finger positioning section.

In the present embodiment, as shown in FIG. 3A, width W1 of the first finger positioning section 201 is a width substantially the same as a left and right width W2 of the four fingers from the index finger to the little finger inserted in the print finger inserting section 20*a* or a width a little wider than the above. The left and right width W2 of the four fingers can be a left and right width of the four fingers according to child, adult, race, etc., or can be an average width of the four fingers.

In the grabbing section 20*c*, a second finger positioning section 202 is provided including a second edge section 202A provided in a position misaligned toward the far side in the inserting direction of the print finger than the first edge section 201A of the first finger positioning section 201. In the second finger positioning section 202, the base U3 between a thumb of a second hand which is the other hand inserted in the print finger inserting section 20*a* and four fingers from an index finger to a little finger of the second hand inserted in the non-print finger inserting section 20*b* comes into contact with the second edge section 202A and the second finger positioning section 202 positions the thumb of the second hand when printing is performed by the printing section 40.

According to the present embodiment, width X in the width direction combining the first finger positioning section 201 with the second finger positioning section 202 provided in the left and right is to be about 200 mm.

The second edge section 202A of the second finger positioning section 202 is provided in a position misaligned toward the far side in the inserting direction Y of the print finger than the first edge section 201A of the first finger positioning section 201. It is not limited how misaligned the second edge section 202A of the second finger positioning section 202 is from the first edge section 201A of the first finger positioning section 201. However, it is preferable that the position of the nail Tb of the thumb and each nail Ta of the other four fingers are substantially aligned in a side direction.

Regarding this point, a hand of a human has a thumb which is shorter compared to the other four fingers, and although the difference varies according to way of grabbing and according to each individual, there is a difference in length of about 40 to 75 mm between the thumb and the other four fingers. Therefore, considering such difference in the length of the finger, it is preferable that the second edge section 202A of the second finger positioning section 202 is misaligned toward the far side in the inserting direction Y of the print finger U1 about 40 to 75 mm than the first edge section 201A of the first finger positioning section 201.

Figure 3B:
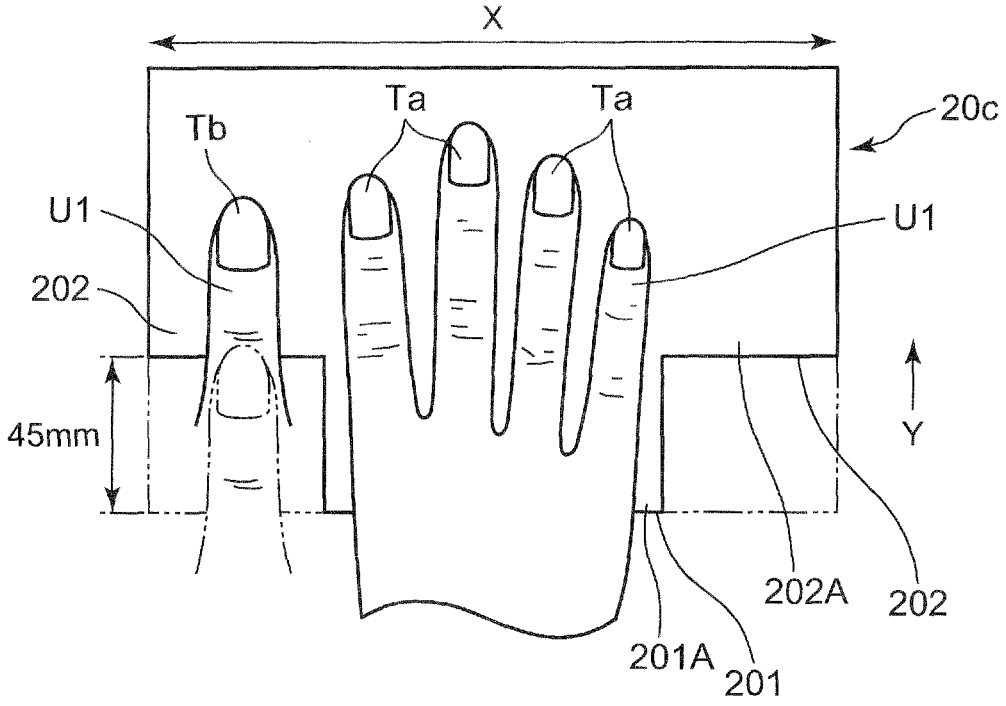
FIG. 3B is a planar view of a grabbing section of the first embodiment, in a state where an index finger to a little finger of a right hand are positioned by a first finger positioning section and a thumb of a left hand is positioned by a second finger positioning section.

FIG. 3A is a diagram showing a state where the four fingers (index finger, middle finger, ring finger and little finger) of the left hand are positioned in the first finger positioning section 201 of the grabbing section 20*c*, and the thumb of the right hand is positioned in the second finger positioning section 202 provided on the right side of the first finger positioning section 201. FIG. 3B is a diagram showing a state where four fingers (index finger, middle finger, ring finger and little finger) of the right hand are positioned in the first finger positioning section 201 of the grabbing section 20*c* and the thumb of the left hand is positioned in the second finger positioning section 202 provided on the left side of the first finger positioning section 201.

In the present embodiment, as shown in FIG. 3A and FIG. 3B, an example is shown where the second edge section 202A of the second finger positioning section 202 is misaligned toward the far side in the inserting direction Y of the print finger U1 at about 45 mm than the first edge section 201A of the first finger positioning section 201.

In FIG. 3A and FIG. 3B, the two dot chain line shows a conventional example of a shape of a portion corresponding to the second finger positioning section 202 in which the edge section of the portion where the four fingers (index finger, middle finger, ring finger, little finger) are positioned and the edge section of the portion where the thumb is positioned are not misaligned in the inserting direction Y of the print finger U1 and a position of the thumb when the thumb is positioned as in the above.

As shown in FIG. 3A and FIG. 3B, when the first edge section 201A which is the portion for positioning the four fingers and the edge section which is the portion for positioning the thumb are not misaligned in the inserting direction Y of the print finger U1, the position of the nail Tb of the thumb and the position of each nail Ta of the other four fingers are greatly misaligned in the inserting direction Y of the print finger U1. Therefore, it is necessary to enlarge the photographable area in which photographing by the later described photographing section 30 is possible and the printable area in which printing by the printing section 40 is possible to an area including all of the nail Tb of the thumb and the nail Ta of the other four fingers.

Regarding this point, when the second edge section 202A of the second finger positioning section 202 which positions the thumb is misaligned toward the far side in the inserting direction Y of the print finger at about 45 mm than the first edge section 201A of the first finger positioning section 201 as shown in the present embodiment, the position of the thumb Tb and each nail Ta of the other four fingers are substantially aligned in the inserting direction Y of the print finger. Therefore, the photographable area of the photographing section 30 and the printable area of the printing section 40 can be made smaller.

Figure 4:
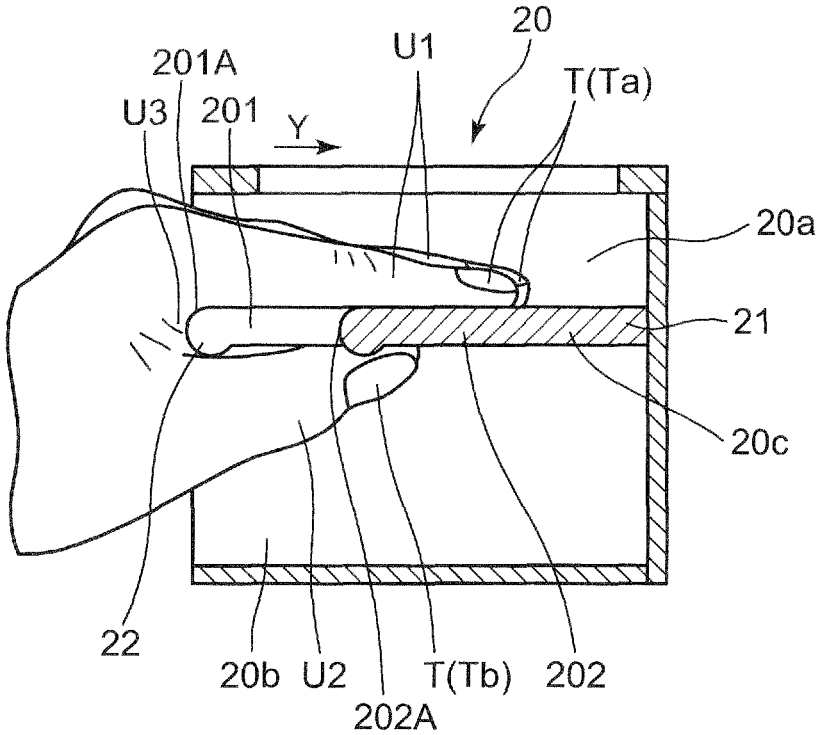
FIG. 4 is a cross sectional view of a print finger fixing section which is a main component of the nail print apparatus shown in FIG. 1 and shows a fixed state when the index finger to the little finger are inserted in the print finger inserting section as the print finger.

FIG. 4 specifically shows an example of a state of fixing the print finger U1 when the four fingers (index finger, middle finger, ring finger and little finger) other than the thumb of the left hand are the print finger U1.

In this case, as shown in FIG. 4, when the user pinches the grabbing section 20*c* with the print finger U1 inserted in the print finger inserting section 20*a* and the non-print finger U2 inserted in the non-print finger inserting section 20*b*, the print finger U1 is fixed on the grabbing section 20*c*.

Figure 5:
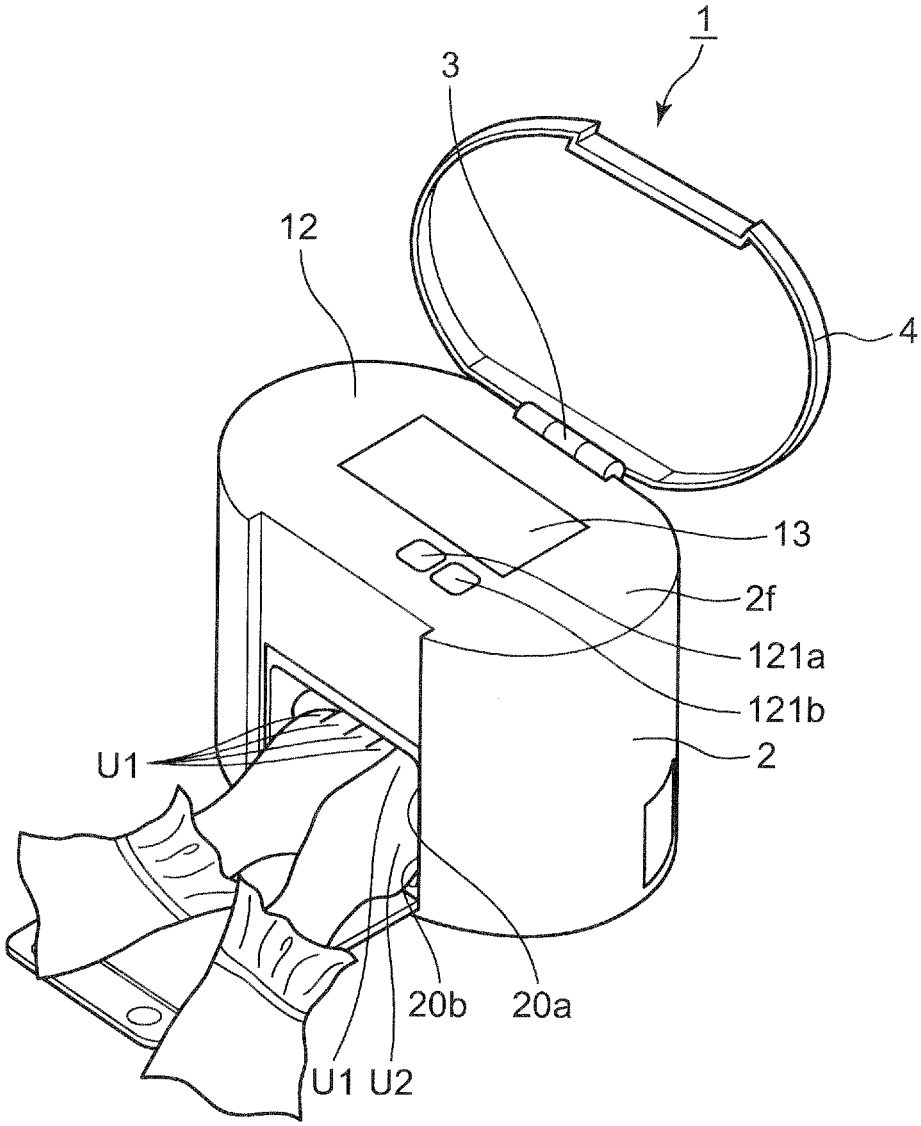
FIG. 5 is a perspective view showing a state where the index finger to the little finger of the left hand and the thumb of the right hand are inserted in the print finger inserting section of the nail print apparatus shown in FIG. 1 as the print finger.

FIG. 5 shows an example of a state of inserting the print finger U1 in printing.

In the nail print apparatus 1 of the present embodiment, the four fingers (index finger, middle finger, ring finger and little finger) other than the thumb of either one of the left or right hand and the thumb of the other hand is the print finger U1.

FIG. 5 shows a state where the four fingers other than the thumb of the left hand and the thumb of the right hand is the print finger U1. In this case, the left hand is inserted in the print finger inserting section 20*a* in a state where the four fingers (print finger U1) other than the thumb are aligned in a planar state and are positioned by the first finger positioning section 201 of the grabbing section 20*c*. The thumb of the left hand (non-print finger U2) is inserted in the non-print finger inserting section 20*b*. The print finger U1 and the non-print finger U2 pinches the grabbing section 20*c* to fix the four fingers which are the print finger U1 (see FIG. 4). The thumb (print finger U1) of the right hand is inserted in the print finger inserting section 20*a* and is positioned by the second finger positioning section 202 of the grabbing section 20*c*. The four fingers (non-print finger U2) other than the thumb of the right hand are inserted in the non-print finger inserting section 20*b*. Then, the print finger U1 and the non-print finger U2 pinch the grabbing section 20*c* to fix the thumb which is the print finger U1.

Figure 6:
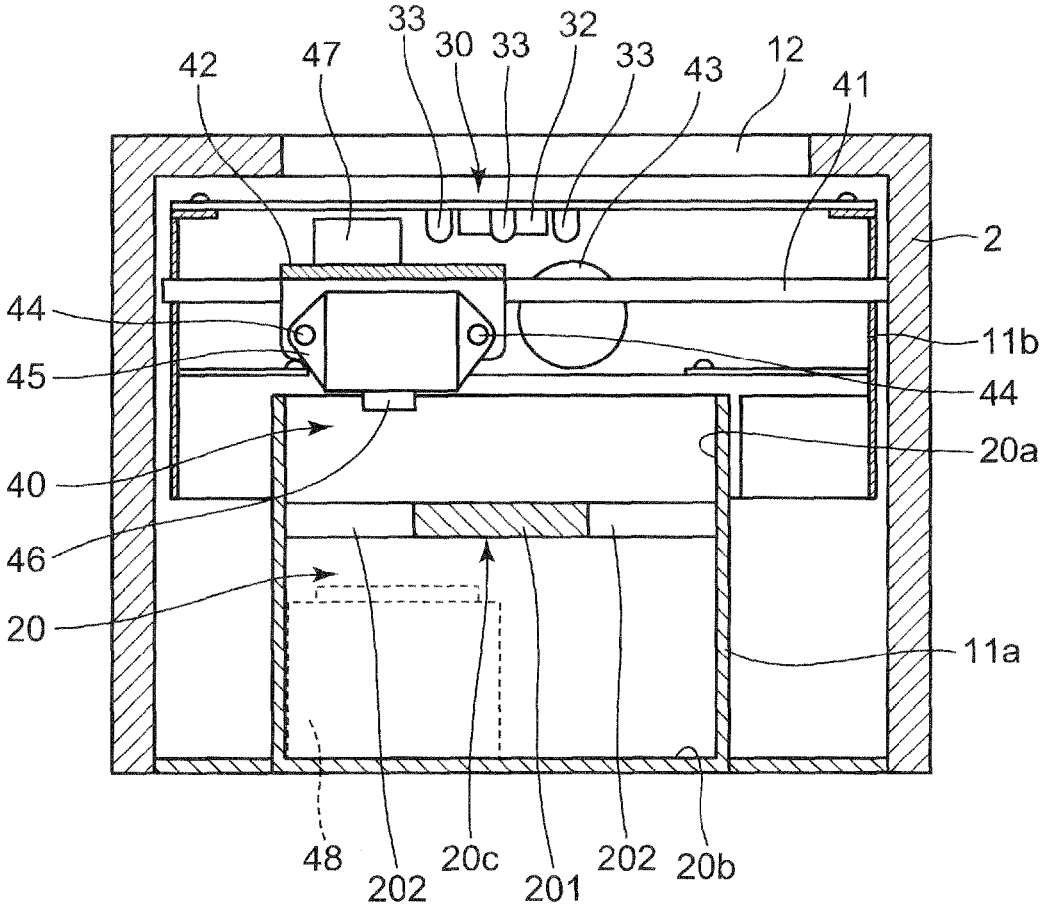
FIG. 6 is a cross sectional view of the nail print apparatus shown in FIG. 1 seen from a front side.
Figure 7:
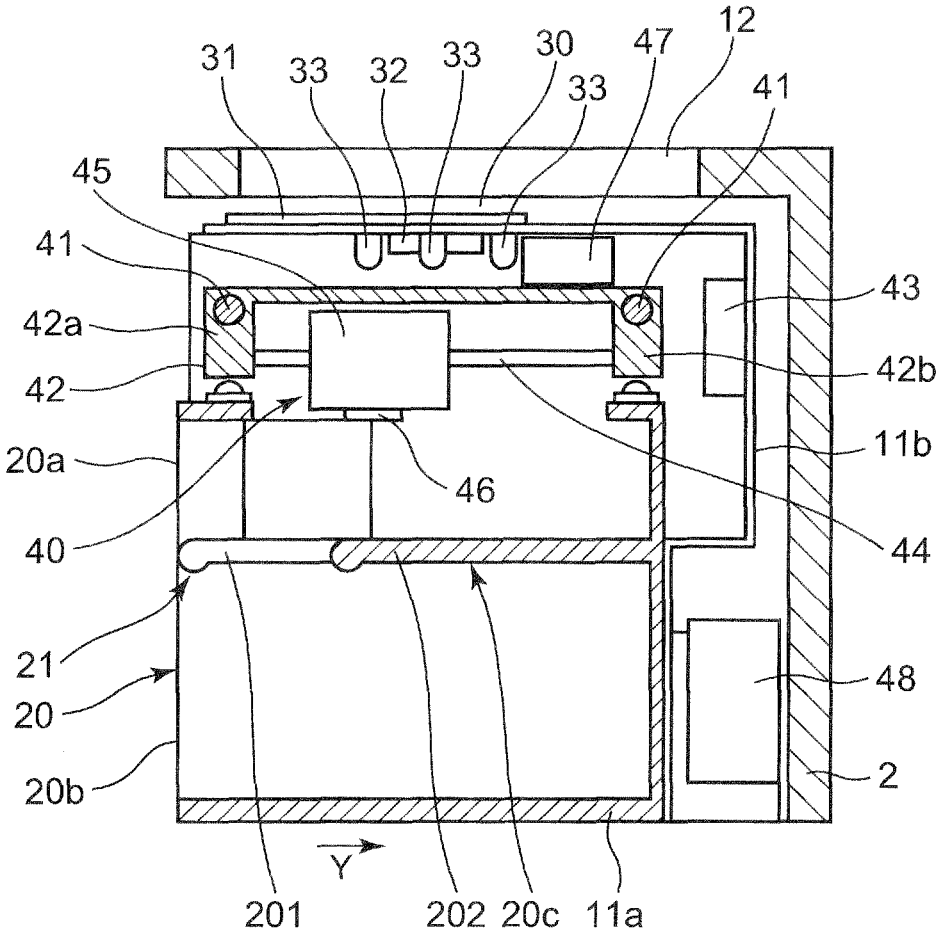
FIG. 7 is a cross sectional view of the nail print apparatus shown in FIG. 1 seen from the side.

FIG. 6 is a cross sectional view of the front side of the nail print apparatus 1 of the present embodiment and FIG. 7 is a cross sectional view of the side of the nail print apparatus 1. As shown in FIG. 6 and FIG. 7, the photographing section 30 is provided in the upper device casing 11*b* of the device casing 11.

In other words, a camera 32 with a pixel of about two million pixels or more including a driver is provided on the bottom face of a center section of a substrate 31 provided in the upper device casing 11*b*. An illuminating lamp 33 of a white color LED, etc. is provided so as to surround the camera 32 on the substrate 31. The photographing section 30 is composed including the camera 32 and the illuminating lamp 33.

The photographing section 30 is a photographing section which illuminates the print finger U1 with the illuminating lamp 33 and photographs the print finger U1 with the camera 32 to import the finger image. The photographing section 30 is connected to a later described controlling section 51 of the controlling device 50 and is controlled by the controlling section 51.

The printing section 40 is provided mainly in the upper device casing 11*b*.

In other words, as shown in FIG. 2 and FIG. 6, two guide rods 41 are provided parallel on both side plates of the upper device casing 11*b*. A main carriage 42 is provided on the guide rod 41 so as to be able to slide. As shown in FIG. 7, two guide rods 44 are provided parallel on the front wall 42*a* and the rear wall 42*b* of the main carriage 42. A sub-carriage 45 is provided on the guide rod 44 so as to be able to slide. A print head 46 is mounted to a center section of the bottom face of the sub-carriage 45.

In the present embodiment, the print head 46 is a print head of an ink jet method which performs printing by making fine drops with ink and spraying the ink directly on the medium to be printed. The recording method of the print head 46 is not limited to the ink jet method.

The main carriage 42 is connected to a motor 43 through a power transmitting section (not shown) and the main carriage 42 moves in the left and right direction along the guide rod 41 by a positive and a negative rotation of the motor 43. The sub-carriage 45 is connected to a motor 47 through a power transmitting section (not shown) and the sub-carriage 45 moves in the front and back direction along the guide rod 44 by a positive and a negative rotation of the motor 47. In the present embodiment, the movable range of the print head 46 is the printable area of the nail print apparatus 1, and the printing of the print finger U1 is performed within the printable area.

An ink cartridge 48 to supply ink to the print head 46 is provided in the lower device casing 11*a*. The ink cartridge 48 is connected to a print head 46 through an ink supplying pipe which is not shown and ink is suitably supplied to the print head 46.

The printing section 40 includes the above guide rod 41, the main carriage 42, the motor 43, the guide rod 44, the sub-carriage 45, the print head 46, the motor 47, the ink cartridge 48, etc.

The motor 43, the print head 46 and the motor 47 of the printing section 40 are connected to the later described controlling section 51 of the controlling device 50 and controlled by the controlling section 51.

In the present embodiment, a printing processing section is composed of the photographing section 30 which photographs the nail T (nail Ta of the four fingers of one hand and the nail Tb of the thumb of the other hand) of the print finger U1 and the printing section 40 which performs printing on the nail area photographed by the photographing section 30.

The operation section 12 is an input section for the user to perform various input operations.

The operation section 12 is provided with operation buttons 121 such as a power source switch button 121*a* to turn the power source of the nail print apparatus 1 to ON, a print start instruction switch button 121*b* to input an instruction to start printing, a pattern selection switch button (not shown) to select a nail image pattern to be printed and buttons to perform other various input.

A display section 13 including a liquid crystal panel (liquid crystal display, LCD) is provided on the top plate 2*f* of the case main body 2. A touch panel may be composed as one on the surface of the display section 13. When a touch panel is included, various input can be performed by touching the surface of the display section 13 by touch operation with a stylus pen (not shown), etc.

Figure 8:
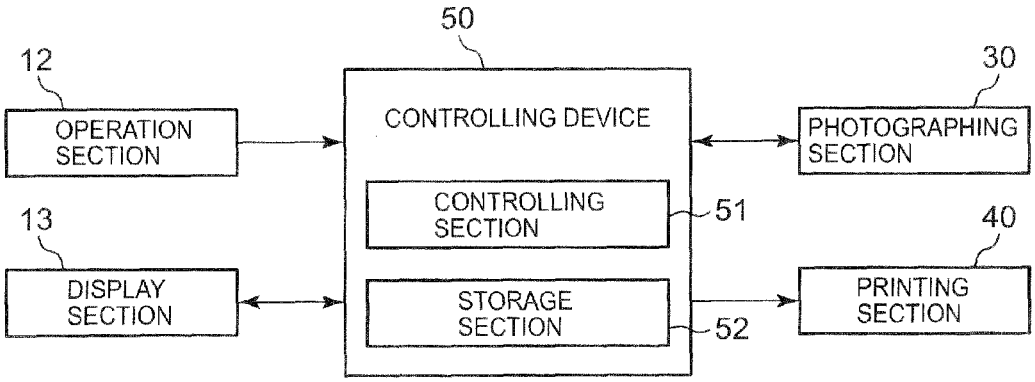
FIG. 8 is a block diagram of a main component showing a control configuration of the nail print apparatus of the present embodiment.

The controlling device 50 is provided on, for example the substrate 31, etc. provided in the upper device casing 11*b*. FIG. 8 is a block diagram of the main components showing the control configuration of the present embodiment.

The controlling device 50 is a computer including a controlling section 51 composed of a CPU (Central Processing Unit), etc. which is not shown, a storage section 52 including a ROM (Read Only Memory), a RAM (Random Access Memory), etc. (all not shown), and the like. The ROM, etc. includes data such as nail image pattern, etc. to be printed and various programs such as print program, etc., and the controlling section 51 performs such programs to control each section.

In the present embodiment, the controlling section 51 functions as a print controlling section which controls the printing section 40, etc. so that printing processing starts after a predetermined amount of time passes from input of the print start instruction.

Specifically, when the print start instruction is input with the print start instruction switch button 121*b* which is the print start instructing section, the controlling section 51 measures the time from when the instruction is input with the print start instruction switch button 121*b*, and controls the printing processing section (in other words, photographing section 30 and printing section 40) to start the printing processing after a predetermined amount of time has passed.

Here, the printing processing is processing to perform printing on the nail T (nail Ta of the four fingers of one hand and nail Tb of the thumb of the other hand) of the print finger U1 and in the present embodiment, photographing of the print finger U1 by the photographing section 30 and printing by the printing section 40.

In other words, when the print start instruction switch button 121 is operated and the print operation starts, the controlling section 51 first controls the photographing section 30 to photograph the print finger U1 and to obtain the image data of the print finger U1 before starting printing by the printing section 40. Then, the controlling section 51 judges the type of print finger U1 inserted in the print finger inserting section 20*a* and the position, size, area, etc. of the nail T of the print finger U1 based on the image data of the print finger U1 obtained by the photographing section 30 to determine the position, area, etc. of printing by the printing section 40.

The controlling section 51 selects the image pattern selected with the pattern selection switch button of the operation section 12 as the nail image pattern to be printed from the ROM, etc., and outputs the data of the nail image pattern to the printing section 40.

Then, when the controlling section 51 determines the position, area, etc. of printing by the printing section 40 and the data of the nail image pattern to be printed is output to the printing section 40, the controlling section 51 controls the printing section 40 to print the selected nail image pattern on the plurality of nails T of the print finger U1.

The predetermined amount of time from when the instruction is input with the print start instruction switch button 121*b* to when the printing processing starts is not limited. Considering the time necessary from when the user operates the print start instruction switch button 121*b* to insert the print finger U1 in the print finger inserting section 20*a*, to insert the non-print finger U2 in the non-print finger inserting section 20*b*, to pinch the grabbing section 20*c* with the print finger U1 and the non-print finger U2, the time can be, for example, about 10 seconds.

In the present embodiment, the controlling section 51 includes a timer function and measures the time that passes from input of the instruction with the print start instruction switch button 121*b*. Then, when the predetermined amount of time passes, the controlling section 51 controls the photographing section 30 and the printing section 40 to start the printing processing.

For example, a configuration to notify the user the timing when the printing processing starts can be employed such as an audio announcement from a speaker announcing that the printing processing starts soon when the predetermined amount of time almost passes (for example, "printing starts in two seconds", etc.), to display the above notice on the display section 13, to light a lamp or the like. With such configuration, the user can be prepared and mentally ready for the printing processing, and it is expected that the user can wait with the print finger U1 in a more preferable position and perform fixing of the finger more securely.

Next, the operation of the nail print apparatus 1 of the present embodiment is described.

According to the nail print apparatus 1 of the present embodiment, printing is performed simultaneously on nails T (nail Ta of the four fingers of one hand and nail Tb of the thumb of the other hand) of a plurality of print fingers U1 of the left and right hand inserted in the print finger inserting section 20*a*. Here, "simultaneous printing" means printing can be performed at once on the print finger U1 inserted in the print finger inserting section 20*a* without removing the finger.

When the printing is performed, the user first turns a power switch 52*a* to ON to start the controlling device 50 and the nail image pattern (design) desired to be printed on the print finger U1 is selected. It is preferable that the selected nail image pattern can be displayed on the display section 13 and that the user can check the design. When the nail image pattern is selected, the user inputs the print start instruction with the print start instruction switch button 121*b*, inserts the print finger U1 in the print finger inserting section 20*a* and inserts the non-print finger U2 in the non-print finger inserting section 20*b*.

For example, when printing is performed on the nail Ta of the four fingers (index finger to little finger) other than the thumb of the left hand and the nail Tb of the thumb of the right hand, the left hand is inserted in the print finger inserting section 20*a* so that the four fingers (print finger U1) other than the thumb are aligned in a planar state and the base between the four fingers which are the print finger U1 and the thumb which is the non-print finger U2 comes into contact with the first edge section 201A of the first finger positioning section 201 of the grabbing section 20*c* and the four fingers (print finger U1) are positioned with the first finger positioning section 201. Then, the four fingers (print finger U1) and the thumb (non-print finger U2) pinch the grabbing section 20*c* to fix the four fingers (print finger U1) (see FIG. 4). As for the right hand, the thumb (print finger U1) is inserted in the print finger inserting section 20*a* and the base between the thumb which is the print finger U1 and the four fingers which are the non-print finger U2 comes into contact with the second edge section 202A of the second finger positioning section 202 provided on the right side of the first finger positioning section 201 in the grabbing section 20*c* to position the thumb (print finger U1) with the second finger positioning section 202.

Here, the second edge section 202A of the second finger positioning section 202 is misaligned toward the far side in the inserting direction Y of the print finger U1 at about 45 mm than the first edge section 201A of the first finger positioning section 201. Therefore, the nail Ta of the four fingers (print finger U1) of the left hand and the nail Tb of the thumb (print finger U1) of the right hand are substantially aligned in a side direction with respect to the inserting direction of the print finger U1.

The controlling section 51 measures the time that passes from the input of the print start instruction with the print start instruction switch button 121*b*, and the controlling section 51 controls the photographing section 30 which performs the photographing of the print finger U1 and the printing section 40 which performs printing to start the printing processing after a predetermined amount of time passes from the input of the print start instruction.

When printing is performed on the nail Ta of the four fingers (index finger to little finger) other than the thumb of the right hand and the nail Tb of the thumb of the left hand, the four fingers (print finger U1) other than the thumb of the right hand are inserted in the print finger inserting section 20*a* and positioned by the first finger positioning section 201. The thumb (print finger U1) of the left hand is inserted in the print finger inserting section 20*a* and positioned by the second finger positioning section 202 provided on the left side of the first finger positioning section 201 of the grabbing section 20*c*. The other points are similar to the above and therefore the description is omitted.

According to the nail print apparatus 1 of the present embodiment, the following effects can be achieved.

In other words, in the present embodiment, the second edge section 202A of the second finger positioning section 202 is misaligned toward the far side in the inserting direction Y of the print finger U1 at about 45 mm than the first edge section 201A of the first finger positioning section 201. Therefore, the nail Ta of the four fingers (print finger U1) of the left hand and the nail Tb of the thumb (print finger U1) of the right hand are substantially aligned in the side direction with respect to the inserting direction of the print finger U1. Therefore, the photographable area of the photographing section 30 and the printable area of the printing section 40 become a few tens of mm shorter in the front and back direction (inserting direction Y of the print finger) of the nail print apparatus 1 and therefore, the moving distance of the print head 46 can be shorter in the above lengths. Therefore, the printing section 40, etc. can be made smaller, lighter, and with less cost, and the entire nail print apparatus 1 can be made smaller and lighter. The nail print apparatus 1 can be made with less cost and the portability of the apparatus increases.

The second finger positioning section 202 which positions the thumb is provided on both the left and the right sides of the first finger positioning section 201 which positions the four fingers, and therefore printing processing can be simultaneously performed on the nail Ta of the four fingers of one of the left and right hands and the nail Tb of the thumb of the other hand.

The printing processing starts after a predetermined amount of time passes from the input of the print start instruction with the print start instruction switch button 121*b*. Therefore, even when both the left and the right hands are inserted in the print finger fixing section 20 to perform printing, the finger can be set after operating the print start instruction switch button 121*b*. Consequently, printing processing can be performed on the nail of the finger of both hands easily without using a foot switch, etc.

The present embodiment describes an example in which the second edge section 202A of the second finger positioning section 202 is linear, however the shape of the second edge section 202A of the second finger positioning section 202 is not limited to this.

Figure 9A:
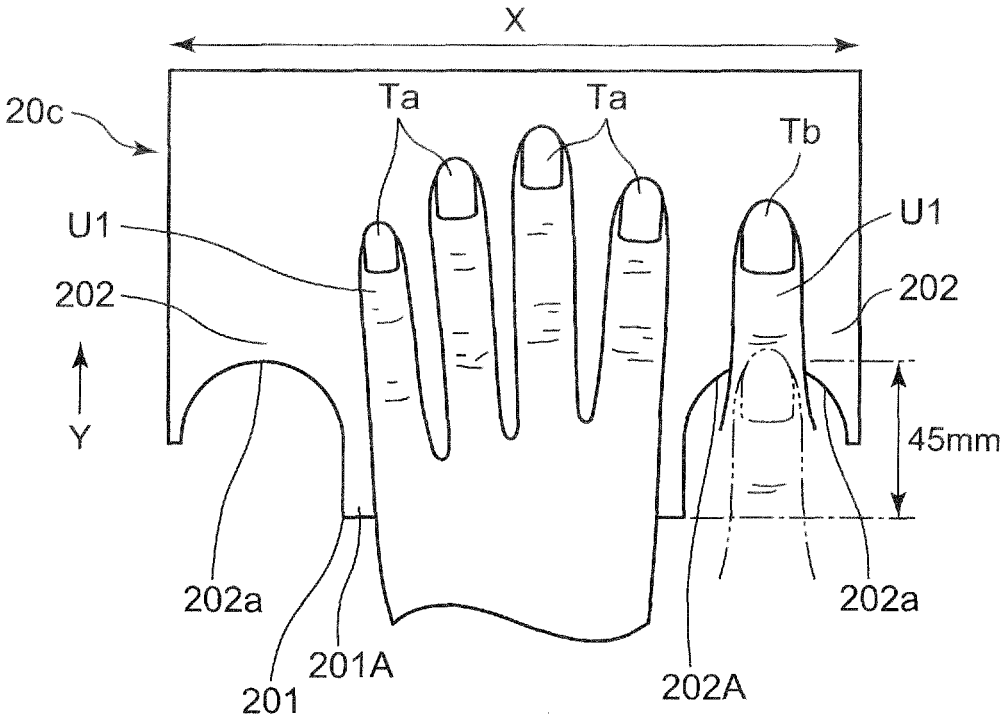
FIG. 9A is a planar view of a modified example of a grabbing section shown in FIG. 3A, in a state where an index finger to a little finger of a left hand is positioned by a first finger positioning section and a thumb of a right hand is positioned by a second positioning section.
Figure 9B:
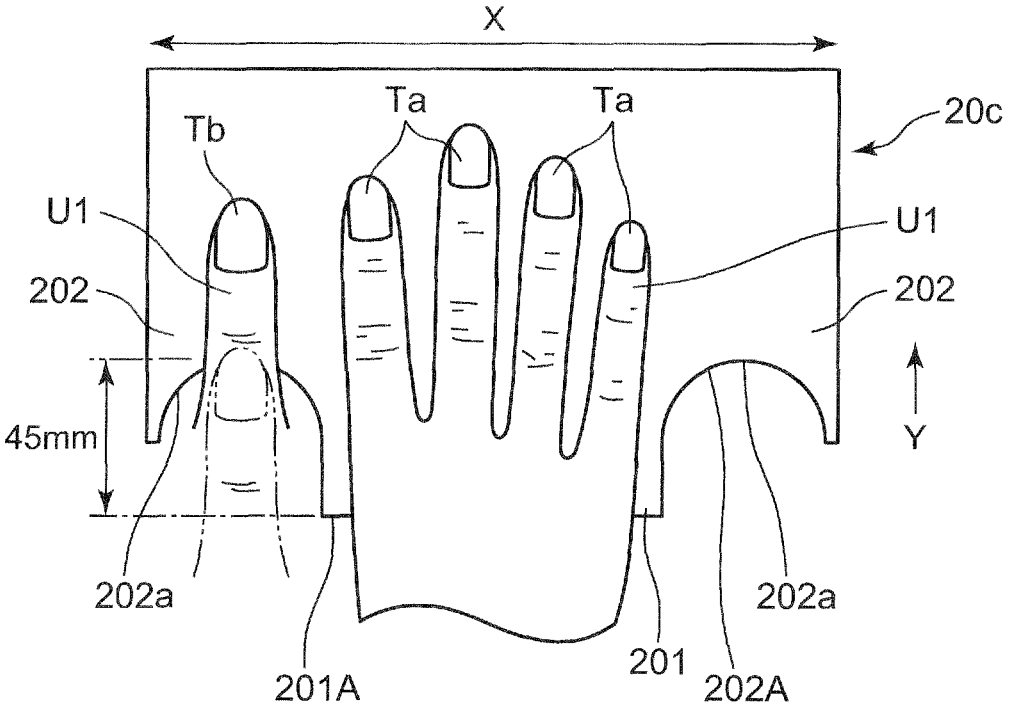
FIG. 9B is a planar view of a modified example of a grabbing section shown in FIG. 3A, in a state where an index finger to a little finger of a right hand is positioned by a first finger positioning section and a thumb of a left hand is positioned by a second finger positioning section.
Figure 10A:
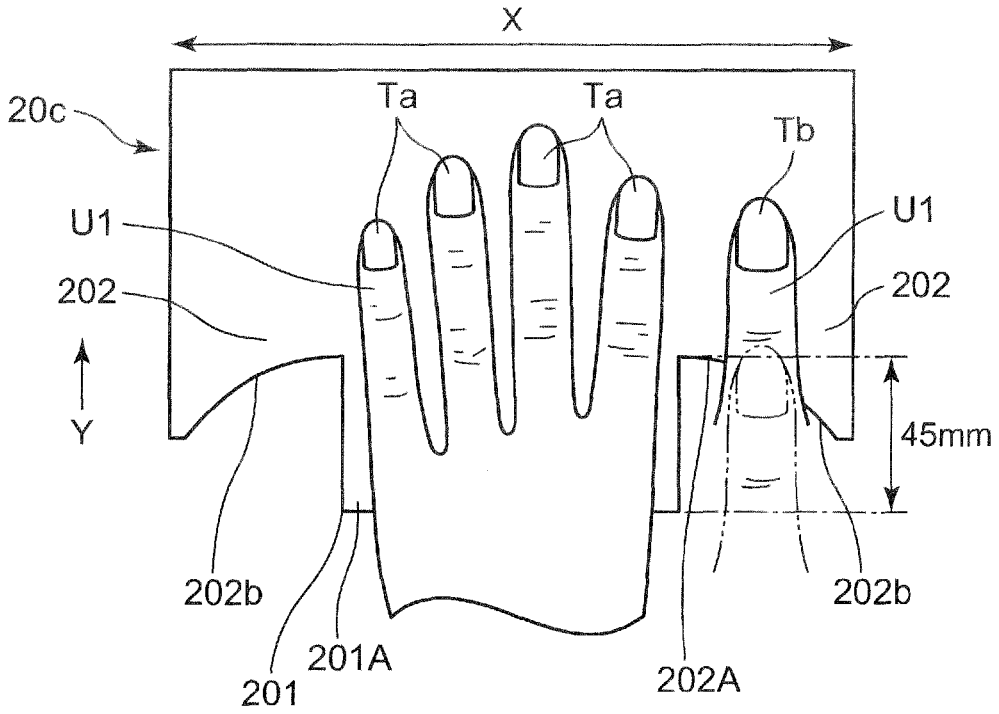
FIG. 10A is a planar view of a modified example of a grabbing section shown in FIG. 3A, in a state where an index finger to a little finger of a left hand is positioned by a first finger positioning section and a thumb of a right hand is positioned by a second positioning section.
Figure 10B:
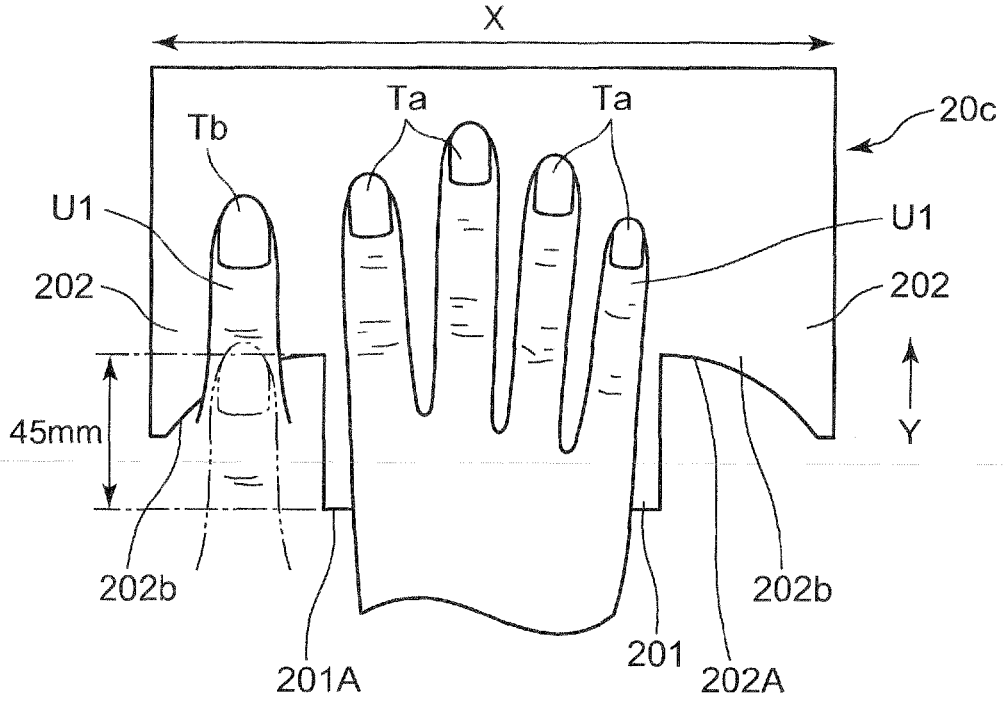
FIG. 10B is a planar view of a modified example of a grabbing section shown in FIG. 3A, in a state where an index finger to a little finger of a right hand is positioned by a first finger positioning section and a thumb of a left hand is positioned by a second finger positioning section.

For example, the second edge section 202A of the second finger positioning section 202 can be formed in a curved shape from a planar view so as to fit the base of the thumb inserted in the print finger inserting section 20*a*. Specifically, for example, as shown in FIG. 9A and FIG. 9B, a curved section 202*a* in a half-circle shape can be formed in the second edge section 202A of the second finger positioning section 202. Also, as shown in FIG. 10A and FIG. 10B, a circular section 202*b* curved from the side section of the first finger positioning section 201 to the edge section of the grabbing section 20*c* can be formed in the second edge section 202A of the second finger positioning section 202. The curved shape is not limited to the illustrated examples.

When the second edge section 202A of the second finger positioning section 202 is a curved shape as shown here, the second edge section 202A of the second finger positioning section 202 naturally fits to the base of the thumb inserted in the print finger inserting section 20*a* and the thumb can be positioned stably.

Second Embodiment

Figure 11A:
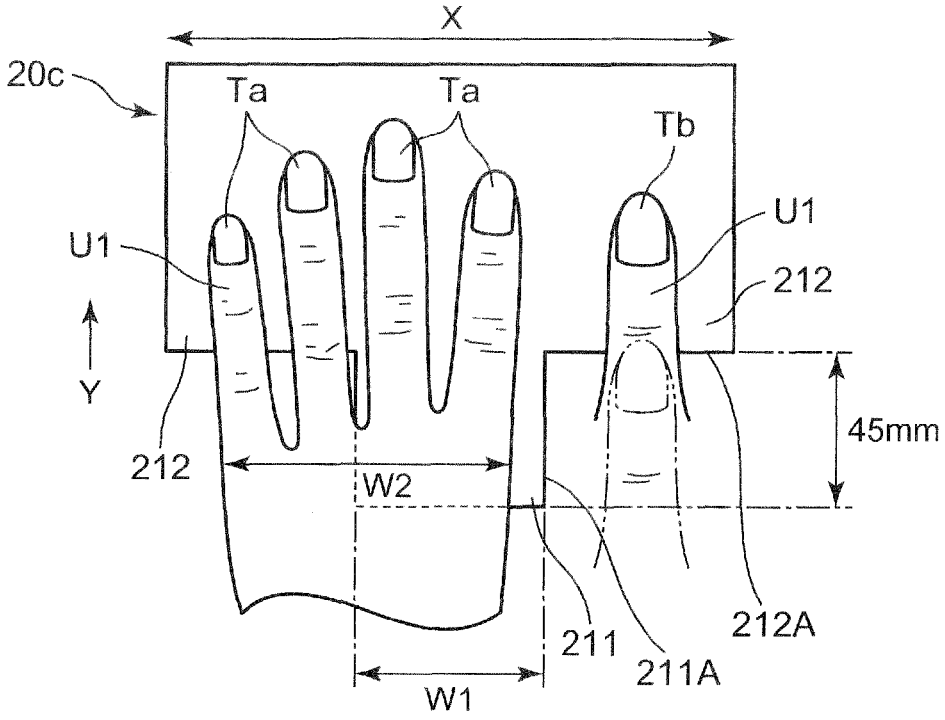
FIG. 11A is a planar view of a grabbing section of the second embodiment, in a state where an index finger to a little finger of a left hand is positioned by a first finger positioning section and a thumb of a right hand is positioned by a second positioning section.
Figure 11B:
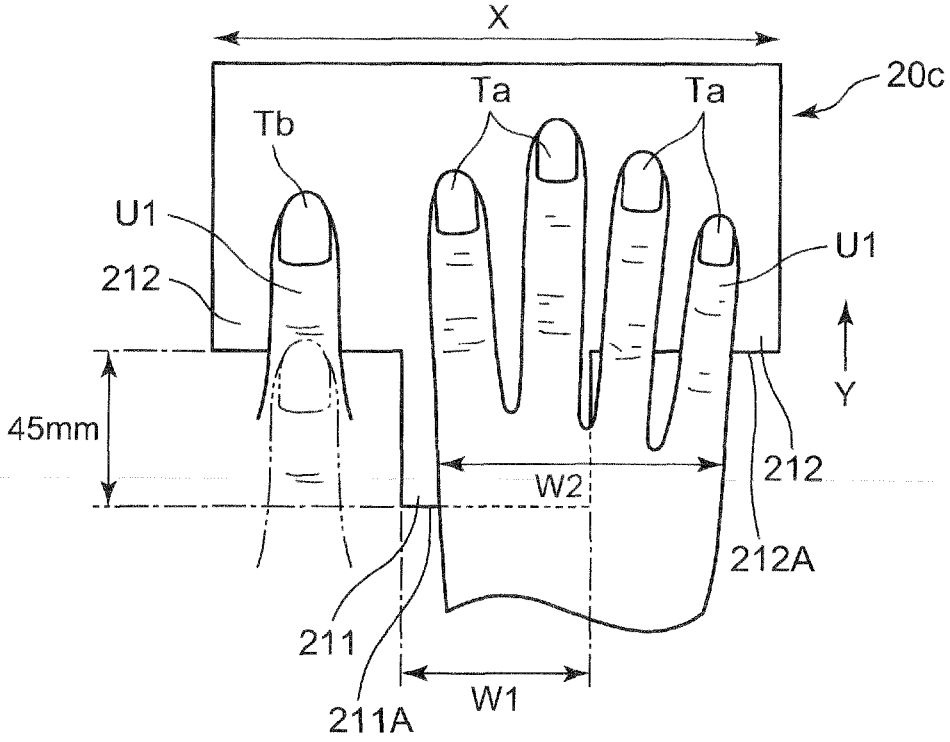
FIG. 11B is a planar view of a grabbing section of the second embodiment, in a state where an index finger to a little finger of a right hand is positioned by a first finger positioning section and a thumb of a left hand is positioned by a second finger positioning section.

Next, the second embodiment of the nail print apparatus of the present invention is described with reference to FIG. 11A and FIG. 11B. In the present embodiment, the configuration of the first finger positioning section and the second finger positioning section of the nail print apparatus is different from that of the first embodiment, and specifically, the points different from the first embodiment are described below.

The configuration of the apparatus of the nail print apparatus 1 of the present embodiment is almost similar to that of the first embodiment.

According to the present embodiment, in the center section in the width direction of the grabbing section 20*c*, a first finger positioning section 211 is provided in which a base U3 between four fingers from an index finger to a little finger which are print finger U1 inserted in the print finger inserting section 20*a* and other finger (in other words, a thumb) which is the non-print finger U2 inserted in the non-print finger inserting section 20*b* comes into contact with an edge section so as to be able to position the four fingers from the index finger to the little finger inserted in the print finger inserting section 20*a*.

In the present embodiment, a length dimension of a width direction X of the first finger positioning section 211 is formed shorter than a left and right width of the four fingers from the index finger to the little finger inserted in the print finger inserting section 20*a*.

In other words, when a human grabs something between the four fingers (index finger to little finger) and the thumb, the target object can be grabbed firmly when the width is the width of the thumb+α. Therefore, in the present embodiment, the width (W1 shown in FIG. 11A and FIG. 11B) of the first finger positioning section 211 which positions the four fingers (index finger to little finger) is made about 50 mm shorter than the left and right width (W2 shown in FIG. 11A and FIG. 11B) of the four fingers from the index finger to the little finger or this dimension+α. For example, when the left and right width W2 of the four fingers form the index finger to the little finger or this dimension+α is 90 mm, the width of the first finger positioning section 211 is about 40 mm. With this, in the present embodiment, the length dimension of the width direction X combining the first finger positioning section 211 and the second finger positioning section 212 provided on the left and right is about 150 mm.

The other configuration is similar to that of the first embodiment, therefore the description is omitted.

Next, the operation of the nail print apparatus of the present embodiment is described.

In the nail print apparatus of the present embodiment, similar to the first embodiment, printing is performed simultaneously on the nails T (nail Ta of the four fingers of one hand and nail Tb of the thumb of the other hand) of the plurality of print fingers U1 of the left and right hand inserted in the print finger inserting section 20*a*.

When printing is performed, after the user inputs the print start instruction with the print start instruction switch button 121*b*, the print finger U1 is inserted in the print finger inserting section 20*a* and the non-print finger U2 is inserted in the non-print finger inserting section 20*b*.

For example, when printing is performed on the nail Ta of the four fingers (index finger to little finger) other than the thumb of the left hand and the nail Tb of the thumb of the right hand, the left hand is inserted in the print finger inserting section 20*a* so that the four fingers (print finger U1) other than the thumb are aligned in a planar state and the base between the four fingers which are the print finger U1 and the thumb which is the non-print finger U2 comes into contact with the first edge section 211A of the first finger positioning section 211 of the grabbing section 20*c* and the four fingers (print finger U1) are positioned by the first finger positioning section 211. Then, the four fingers (print finger U1) and the thumb (non-print finger U2) pinch the grabbing section 20*c* to fix the four fingers (print finger U1) (see FIG. 4). As for the right hand, the thumb (print finger U1) is inserted in the print finger inserting section 20*a* and the base between the thumb which is the print finger U1 and the four fingers which are the non-print finger U2 comes into contact with the second edge section 212A of the second finger positioning section 212 provided on the right side of the first finger positioning section 211 in the grabbing section 20*c* to position the thumb (print finger U1) with the second finger positioning section 212.

Here, the second edge section 212A of the second finger positioning section 212 is misaligned toward the far side in the inserting direction Y of the print finger U1 at about 45 mm than the first edge section 211A of the first finger positioning section 211. Therefore, the nail Ta of the four fingers (print finger U1) of the left hand and the nail Tb of the thumb (print finger U1) of the right hand are substantially aligned in a side direction with respect to the inserting direction of the print finger U1.

The controlling section 51 measures the time that passes from the input of the print start instruction with the print start instruction switch button 121*b*, and the controlling section 51 controls the photographing section 30 which performs the photographing of the print finger U1 and the printing section 40 which performs printing to start the printing processing after a predetermined amount of time passes from the input of the print start instruction.

When printing is performed on the nail Ta of the four fingers (index finger to little finger) other than the thumb of the right hand and the nail Tb of the thumb of the left hand, the four fingers (print finger U1) other than the thumb of the right hand are inserted in the print finger inserting section 20*a* and positioned by the first finger positioning section 211. The thumb (print finger U1) of the left hand is inserted in the print finger inserting section 20*a* and positioned by the second finger positioning section 212 provided on the left side of the first finger positioning section 211 of the grabbing section 20*c*. The other points are similar to the above and therefore the description is omitted.

According to the nail print apparatus of the present embodiment, the following effects can be achieved.

In other words, in the present embodiment, similar to the first embodiment, the second edge section 212A of the second finger positioning section 212 is misaligned toward the far side in the inserting direction Y of the print finger U1 at about 45 mm than the first edge section 211A of the first finger positioning section 211. Therefore, the nail Ta of the four fingers (print finger U1) of the left hand and the nail Tb of the thumb (print finger U1) of the right hand are substantially aligned in the side direction with respect to the inserting direction of the print finger U1. Therefore, the photographable area of the photographing section 30 and the printable area of the printing section 40 become a few tens of mm shorter in the front and back direction (inserting direction Y of the print finger) of the nail print apparatus and therefore, the moving distance of the print head 46 can be shorter in the above lengths. Therefore, the printing section 40, etc. can be made smaller, lighter, and with less cost, and the entire nail print apparatus can be made smaller and lighter. The nail print apparatus can be made with less cost and the portability of the apparatus increases.

Moreover, in the present embodiment, compared to when the width of the first finger positioning section 211 is made the same or larger than the width of the four fingers, the length dimension of the width direction (X direction shown in FIG. 11A and FIG. 11B) of the grabbing section 20*c* can be made shorter at about a few tens of mm. Therefore, the photographable area of the photographing section 30 and the printable area of the printing section 40 can be made small to the above extent. Therefore, the printing section 40, etc. can be made smaller, lighter, and with less cost, and the entire nail print apparatus can be made smaller and lighter and the portability of the apparatus increases.

Other effects similar to those of the first embodiment can also be achieved by the present embodiment.

The present embodiment describes an example in which the second edge section 212A of the second finger positioning section 212 is linear, however the shape of the second edge section 212A of the second finger positioning section 212 is not limited to this, and for example, similar to the first embodiment, the second edge section 212A of the second finger positioning section 212 can be formed in a curved shape from a planar view so as to fit the base of the thumb inserted in the print finger inserting section 20*a*.

Third Embodiment

Next, the third embodiment of the nail print apparatus of the present invention is described with reference to FIG. 12A, FIG. 12B, FIG. 13A and FIG. 13B. In the present embodiment, the configuration of the first finger positioning section and the second finger positioning section of the nail print apparatus is different from that of the first embodiment and the second embodiment and specifically, the points different from the first embodiment and the second embodiment are described below.

The configuration of the apparatus of the nail print apparatus of the present embodiment is almost similar to that of the first embodiment and the second embodiment.

Figure 12A:
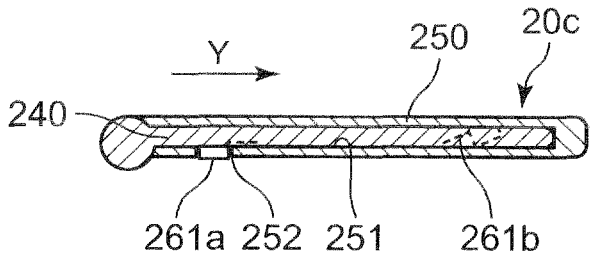
FIG. 12A is a cross sectional view of a grabbing section of the third embodiment.
Figure 12B:
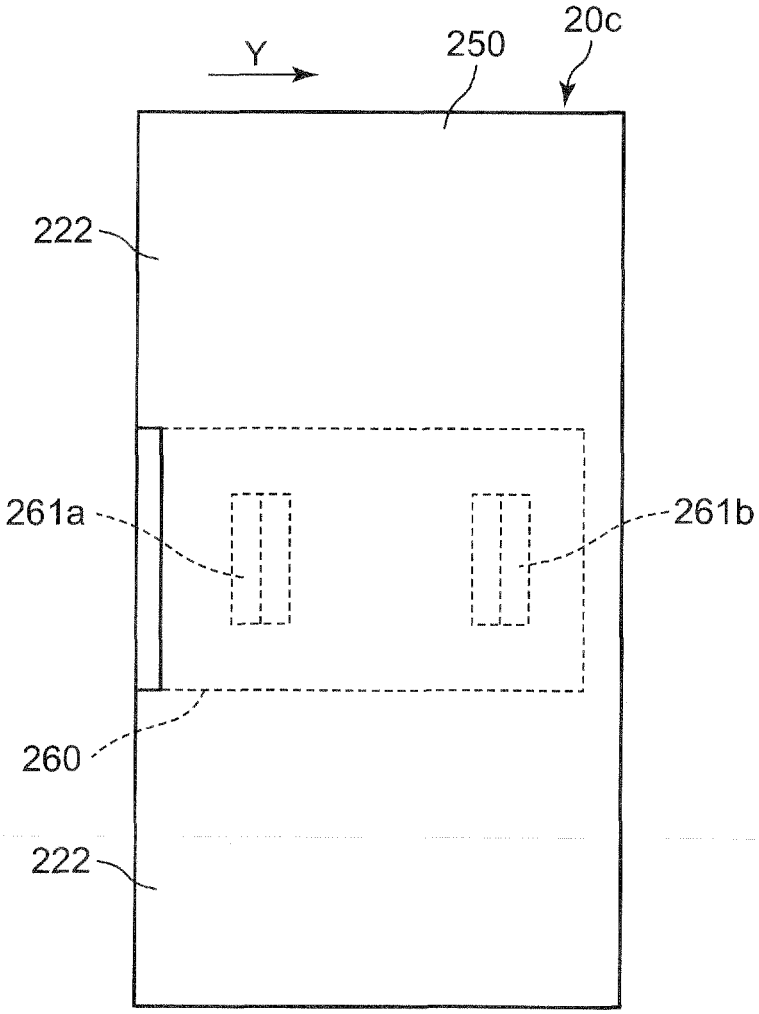
FIG. 12B is a planar view of the grabbing section shown in FIG. 12A viewed from above.
Figure 13A:
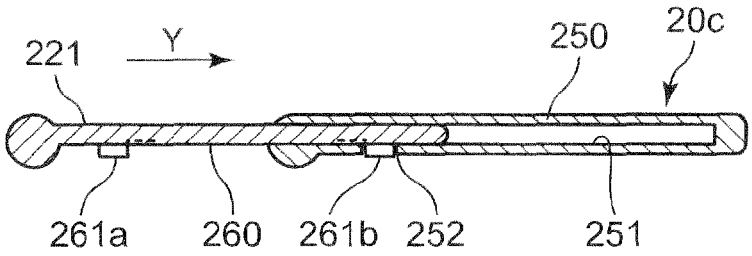
FIG. 13A is a cross sectional view showing a state where a pull out plate is pulled out from the grabbing section shown in FIG. 12A.
Figure 13B:
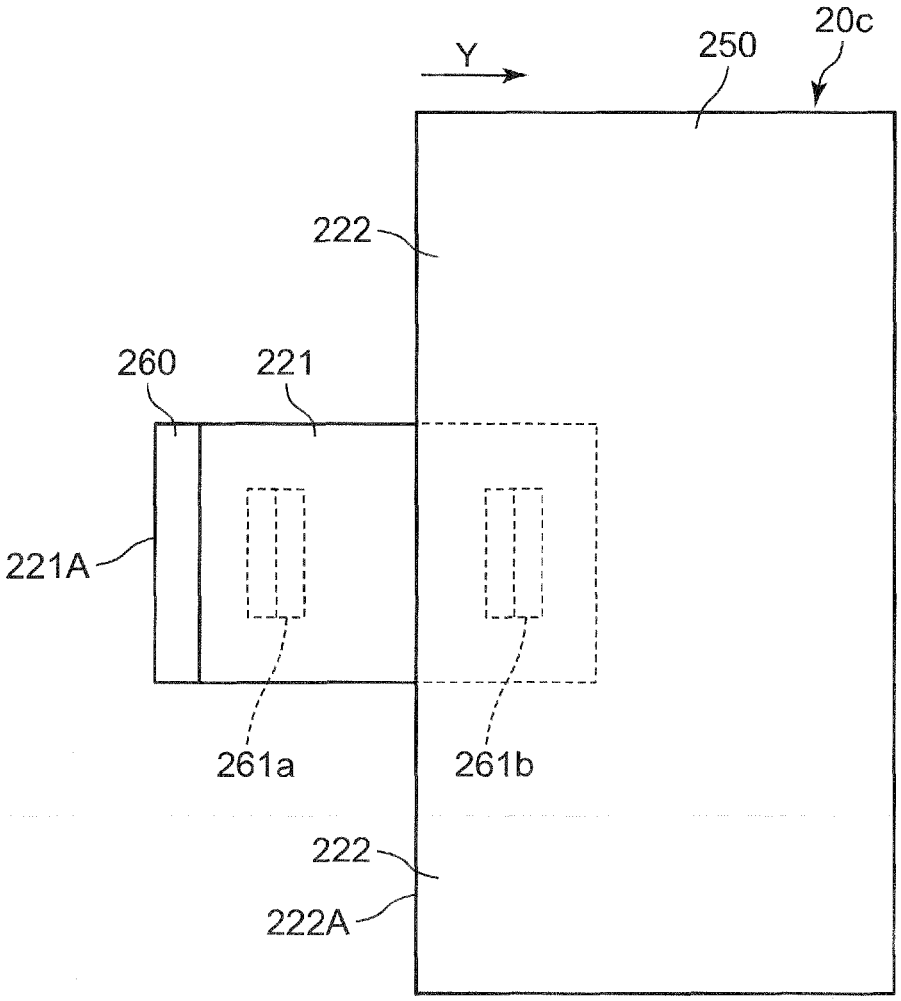
FIG. 13B is a planar view of the grabbing section shown in FIG. 13A viewed from above.

FIG. 12A and FIG. 13A are side cross sectional views of the grabbing section 20*c* including the first finger positioning section 221 and the second finger positioning section 222 and FIG. 12B and FIG. 13B are planar views of the grabbing section 20*c* shown in FIG. 12A and FIG. 13A viewed from above.

In the present embodiment, the grabbing section 20*c* includes a grabbing section main body 250 including the second finger positioning section 222 on both edge sections in the width direction and a pull out plate 260 provided so that the pull out plate 260 can be pulled out toward the near side in the inserting direction Y of the print finger U1 when inserted into the print finger inserting section 20*a* with respect to the grabbing section main body 250, provided in substantially the center section in the width direction of the grabbing section main body 250.

A pull out plate storing section 251 which is a space where the pull out plate 260 can be stored is provided inside the grabbing section main body 250. A plate latching hole section 252 is formed near an edge section of the rear face side (bottom side in FIG. 12A) of the pull out plate storing section 251.

Plate latching protruding sections 261*a* and 261*b* are provided near an edge section in the pull out direction of the pull out plate 260 and near an edge section of the storing direction (in other words, the inserting direction Y of the print finger U1). The plate latching protruding sections 261*a* and 261*b* are members including elasticity such as a plate spring, etc. As shown in FIG. 12A and FIG. 12B, when the pull out plate 260 is in a stored state stored in the pull out plate storing section 251, the plate latching protruding section 261*a* provided near the edge section in the pull out direction of the pull out plate 260 is latched to the plate latching hole section 252 of the grabbing section main body 250 and the pull out plate 260 can be maintained in a stored state stored in the pull out plate storing section 251.

As shown in FIG. 13A and FIG. 13B, in a pulled out state where the pull out plate 260 is pulled out from the pull out plate storing section 251, the plate latching protruding section 261*b* provided near the edge section in the storing direction of the pull out plate 260 is latched to the plate latching hole section 252 of the grabbing section main body 250, in order to prevent the pull out plate 260 from falling out of the pull out plate storing section 251 or being pushed back into the pull out plate storing section 251.

The configuration to latch the pull out plate 260 is not limited to the configuration illustrated here.

The pull out plate 260 composes a first finger positioning section 221 which positions the four fingers (index finger to little finger) of either one of the left or right hand inserted in the print finger inserting section 20*a* in a pulled out state where the pull out plate 260 is pulled out from the pull out plate storing section 251.

In the present embodiment, the base U3 between the print finger U1 inserted in the print finger inserting section 20*a* and the non-print finger U2 inserted in the non-print finger inserting section 20*b* comes into contact with the first edge section 221A of the pull out side of the pull out plate 260 in a state where the pull out plate 260 is pulled out and the four fingers from the index finger to the little finger inserted in the print finger inserting section 20*a* can be positioned.

Moreover, the thumb of the other hand comes into contact with the second edge section 222A of the second finger positioning section 222 provided on the edge section of the width direction of the grabbing section main body 250 and the thumb inserted in the print finger inserting section 20*a* can be positioned.

The other configuration is similar to that of the first embodiment and the second embodiment and therefore the description is omitted.

Next, the operation of the nail print apparatus of the present embodiment is described.

When the printing is performed on the nail of the print finger U1, the pull out plate 260 is pulled out to the near side (opposite direction of the inserting direction Y of the print finger U1) from the pull out plate storing section 251 while pushing the plate latching protruding section 261*a* of the pull out plate 260 latched to the plate latching hole section 252 of the grabbing section main body 250 upward. The pull out plate 260 becomes the pulled out state when the pull out plate 260 is pulled out to the position where the plate latching protruding section 261*b* provided on the far side of the pull out plate 260 is latched to the plate latching hole section 252.

In the pulled out state, the four fingers (index finger to little finger) of either one of the left or right hand stored in the print finger inserting section 20*a* are positioned with the first edge section 221A of the first finger positioning section 221. Then, for example, the thumb of the other hand comes into contact with the second edge section 222A of the second finger positioning section 222 provided on the edge section in the width direction of the grabbing section main body 250 and the thumb inserted in the print finger inserting section 20*a* is positioned.

Then, printing processing is performed in a state where the print finger U1 of the left and right hand are positioned as described above.

After the printing processing, the user pushes the pull out plate 260*a* to the far side while pushing the plate latching protruding section 261*b* of the pull out plate 260 latched to the plate latching hole section 252 of the grabbing section main body 250 upward. When the pull out plate 260 is pushed to the position where the plate latching protruding section 261*a* of the near side of the pull out plate 260 is latched to the plate latching hole section 252, the plate latching protruding section 261*a* is latched to the plate latching hole section 252 and the pull out plate 260 is fixed so that the pull out plate 260 jumping out from the pull out plate storing section 251 can be prevented.

According to the nail print apparatus 1 of the present embodiment, the following effects can be obtained.

In other words, according to the present embodiment, the effects similar to the first embodiment and the second embodiment can be obtained. Moreover, when printing is not performed, the pull out plate 260 composing the first finger positioning section 221 can be stored in the pull out plate storing section 251 of the grabbing section main body 250 and the length dimension in the inserting direction Y of the print finger U1 of the grabbing section main body 250 is enough with the length of the second finger positioning section 222 which positions the thumb. Therefore, the length in the inserting direction Y of the print finger U1 in the nail print apparatus can be made shorter and the entire nail print apparatus can be made smaller and lighter and also the portability is enhanced.

Fourth Embodiment

Next, the fourth embodiment of the nail print apparatus of the present invention is described with reference to FIG. 14A, FIG. 14B, FIG. 15A and FIG. 15B. In the present embodiment, the configuration of the first finger positioning section and the second finger positioning section of the nail print apparatus is different from that of the first embodiment to the third embodiment, and specifically, the points different from the first embodiment to the third embodiment are described below.

The configuration of the apparatus of the nail print apparatus of the present embodiment is almost similar to that of the first embodiment to the third embodiment.

Figure 14A:
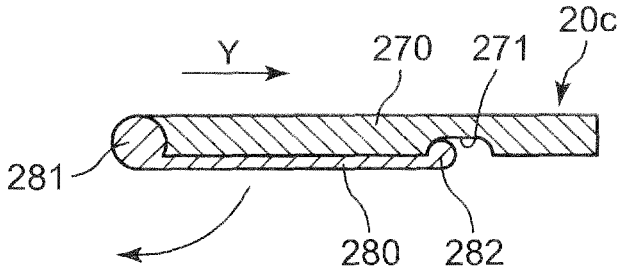
FIG. 14A is a cross sectional view of a grabbing section of the fourth embodiment.
Figure 14B:
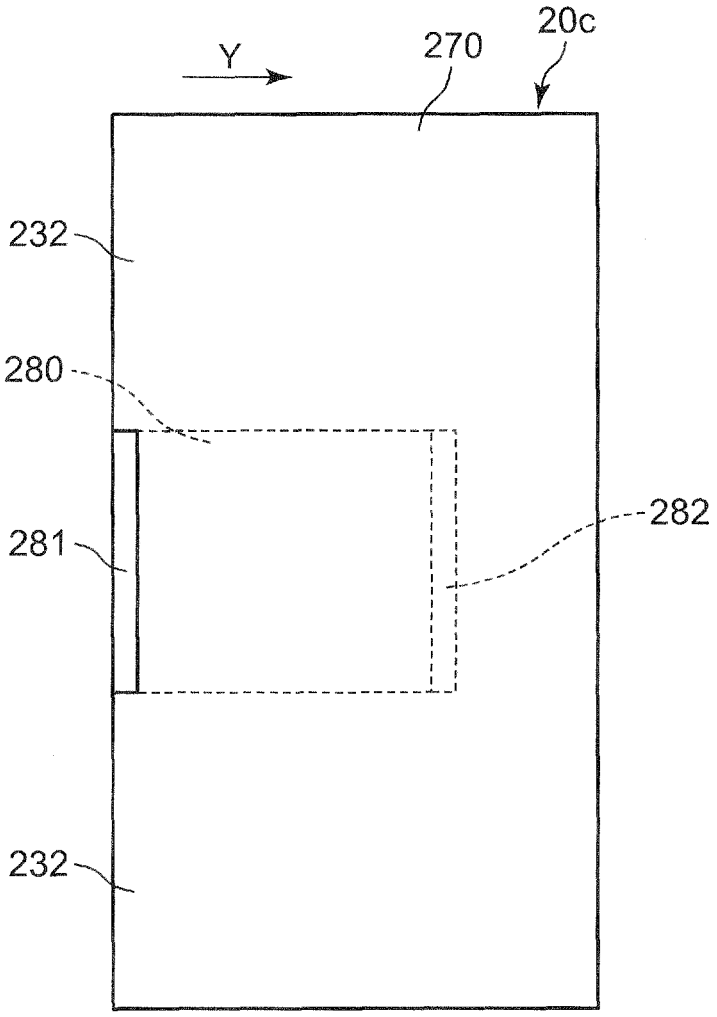
FIG. 14B is a planar view of the grabbing section shown in FIG. 14A viewed from above.
Figure 15A:
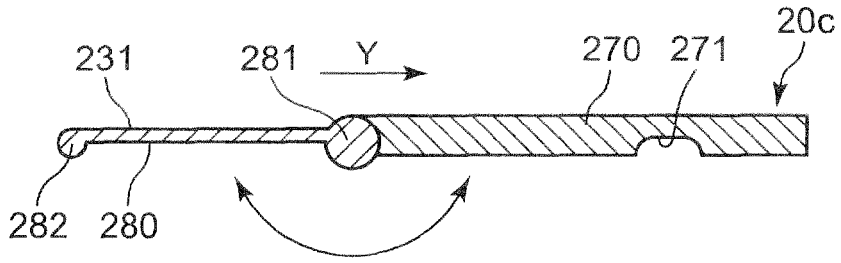
FIG. 15A is a cross sectional view showing a state where a pull out plate is pulled out from the grabbing section shown in FIG. 14A.
Figure 15B:
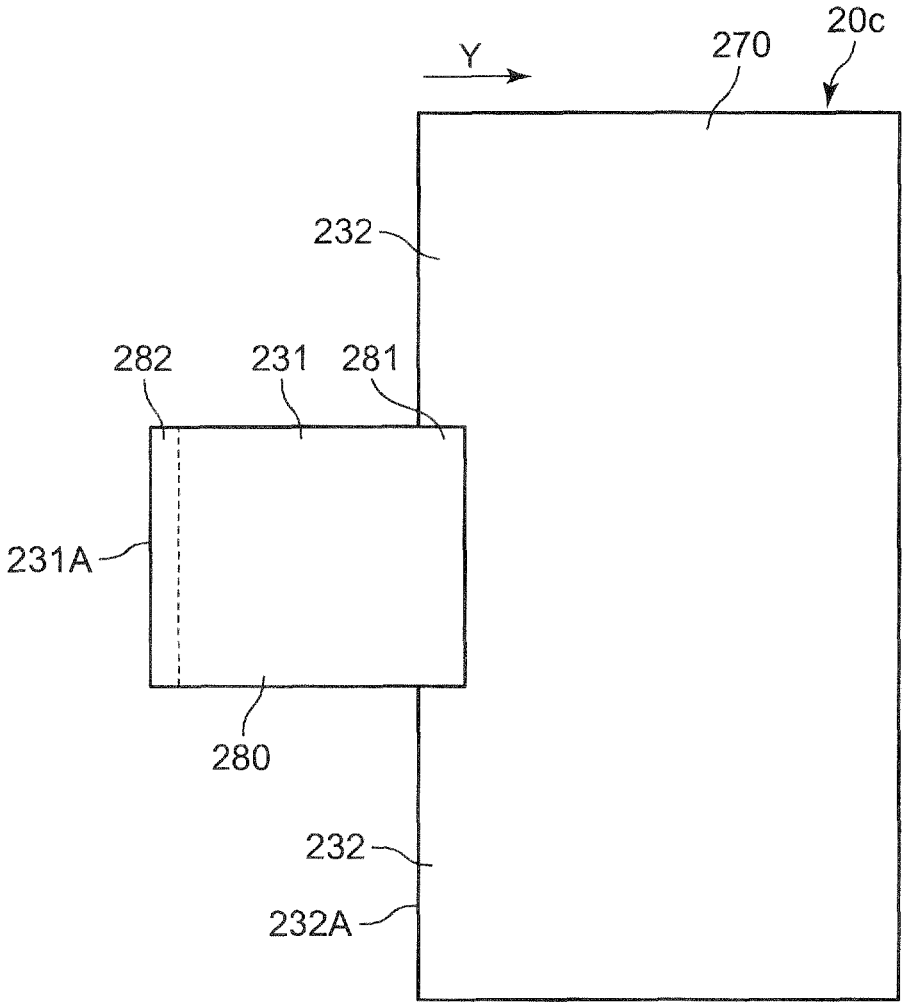
FIG. 15B is a planar view of the grabbing section shown in FIG. 15A viewed from above.

FIG. 14A and FIG. 15A are side cross sectional views of the grabbing section 20*c* including the first finger positioning section 231 and the second finger positioning section 232 and FIG. 14B and FIG. 15B are planar views of the grabbing section 20*c* shown in FIG. 14A and FIG. 15A viewed from above.

In the present embodiment, the grabbing section 20*c* includes a grabbing section main body 270 including the second finger positioning section 232 on both edge sections in the width direction and a rotating plate 280 connected to the edge section of substantially the center section in the width direction of the grabbing section main body 270 through a hinge section 281.

The rotating plate 280 rotates with the hinge section 281 as the axis and can be rotated from an extending state extending to the near side in the inserting direction Y of the print finger U1 when inserted into the print finger inserting section 20*a* with respect to the grabbing section main body 270 to an overlapping state in which the rotating plate 280 is overlapped with the grabbing section main body 270.

The hinge section 281 is provided with a latching protrusion not shown and the grabbing section main body 270 is provided with a groove section (not shown) which receives the protrusion and the groove section is formed in a position corresponding to the latching protrusion. The latching protrusion and the groove section match each other when the rotating plate 280 is in the extending state or the overlapped state. The groove section can be provided on the rotating plate 280 side and the latching protrusion can be provided on the grabbing section main body 270 side.

A latching protrusion 282 is provided on the edge section of the rotating side of the rotating plate 280 and a latching cut out section 271 is formed on the bottom side of the grabbing section main body 270 so as to be latched with the latching protrusion 282 of the rotating plate 280 when the rotating plate 280 is in an overlapping state overlapped with the grabbing section main body 270. The overlapping state of the rotating plate 280 is maintained by latching the latching protrusion 282 of the rotating plate 280 to the latching cut out section 271.

The configuration to latch the rotating plate 280 is not limited to the configuration illustrated above.

The rotating plate 280 composes a first finger positioning section 231 which positions the four fingers (index finger to little finger) of either one of the left or right hand inserted in the print finger inserting section 20*a* in an extending state.

In the present embodiment, the base U3 between the print finger U1 inserted in the print finger inserting section 20*a* and the non-print finger U2 inserted in the non-print finger inserting section 20*b* comes into contact with the first edge section 231A of the extending side (rotating side) of the rotating plate 280 in a state where the rotating plate 280 is in an extending state. With this, the four fingers from the index finger to the little finger inserted in the print finger inserting section 20*a* can be positioned.

Moreover, the thumb of the other hand comes into contact with the second edge section 232A of the second finger positioning section 232 provided on the edge section of the width direction of the grabbing section main body 270 and the thumb inserted in the print finger inserting section 20*a* can be positioned.

The other configuration is similar to that of the first embodiment to the third embodiment and therefore the description is omitted.

Next, the operation of the nail print apparatus of the present embodiment is described.

When printing is performed on the nail of the print finger U1, the latching protrusion 282 of the rotating plate 280 latched to the latching cut out section 271 of the grabbing section main body 270 is unlatched and the rotating plate 280 is rotated to an extending state. Here, the latching protrusion of the rotating plate 280 and the groove section of the grabbing section main body 270 are fit to each other and the rotating plate 280 is fixed in the extending state.

In the extending state, the four fingers (index finger to little finger) of either one of the left or right hand stored in the print finger inserting section 20*a* are positioned with the first edge section 231A of the first finger positioning section 231. Then, for example, the thumb of the other hand comes into contact with the second edge section 232A of the second finger positioning section 232 provided on the edge section in the width direction of the grabbing section main body 270 and the thumb inserted in the print finger inserting section 20*a* is positioned.

Then, printing processing is performed in a state where the print finger U1 of the left and right hand is positioned as described above.

After the printing processing, the user rotates the rotating plate 280 to a position in an overlapped state where the rotating plate 280 is overlapped with the grabbing section main body 270 and latches the latching protrusion 282 of the rotating plate 280 to the latching cut out section 271 of the grabbing section main body 270. With this, the rotating plate 280 is fixed and the shaking when the apparatus is moved can be prevented.

According to the description above, the nail print apparatus 1 of the present embodiment includes: a print finger inserting section 20*a* to insert a finger with a nail to be printed as a print finger U1; a non-print finger inserting section 20*b* to insert a finger on which printing is not performed as a non-print finger U2, the non-print finger inserting section provided in a position near the print finger inserting section; a grabbing section 20*c* which is provided between the print finger inserting section and the non-print finger inserting section and which can be pinched with the print finger inserted in the print finger inserting section and the non-print finger inserted in the non-print finger inserting section; and a printing section 40 which performs printing on a nail of the print finger inserted in the print finger inserting section, wherein the grabbing section 20*c* includes a first finger positioning section 201 in which a base between four fingers from an index finger to a little finger of a first hand which is one hand inserted in the print finger inserting section and a thumb of the first hand inserted in the non-print finger inserting section comes into contact with a first edge section 201A, 211A, 221A, 231A to position the four fingers when printing is performed by the printing section 40; and a second finger positioning section 202 which includes a second edge section 202A, 212A, 222A, 232A positioned in a position misaligned to a far side in an inserting direction of the print finger than the first edge section 201A, 211A, 221A, 231A of the first finger positioning section, wherein a base between a thumb of a second hand which is the other hand inserted in the print finger inserting section and four fingers from an index finger to a little finger of the second hand inserted in the non-print finger inserting section comes into contact with the second edge section 202A, 212A, 222A, 232A to position the thumb of the second hand when printing is performed by the printing section 40.

Preferably, the first finger positioning section 201 is provided on a center section in a width direction of the grabbing section 20*c*; and the second finger positioning section 202 is provided on both left and right sides of the first finger positioning section.

Preferably, the width W1 of the first finger positioning section 201 is formed at a same width or a wider width than a left and right width W2 of the four fingers of the first hand.

Preferably, the second finger positioning section 202 is formed in a curved shape from a planar view so as to fit a base of the thumb of the second hand.

Preferably, the grabbing section 20*c* includes: a grabbing section main body 250 which includes the second finger positioning section 222 on both edge sections in a width direction; and a pull out plate 260 which composes the first finger positioning section 221 in a pulled out state and which is provided on a center section in a width direction of the grabbing section main body so as to be able to be pulled out to a near side of an inserting direction of the print finger when inserted into the print finger inserting section 20*a* with respect to the grabbing section main body.

The grabbing section 20*c* includes: a grabbing section main body 270 which includes the second finger positioning section 232 on both edge sections in a width direction; and a rotating plate 280 which composes the first finger positioning section 231 in an extending state and which is configured on an edge section of a center section in a width direction of the grabbing section main body to be rotatable from an extending state extending to a near side of an inserting direction of the print finger when inserted into the print finger inserting section 20*a* of the grabbing section main body to an overlapping state overlapping with the grabbing section main body.

The nail print apparatus further includes: a print start instructing section 121*b* which receives input of a start instruction of printing by the printing section; and a print controlling section 51 which controls the printing section to start printing processing after a predetermined amount of time passes after the print start instruction is input on the print start instructing section.

According to the nail print apparatus of the present embodiment, the following effects can be achieved.

In other words, according to the present embodiment, the same effects as those of the first embodiment and the second embodiment can be achieved. Moreover, when the printing is not performed, the rotating plate 280 which compose the first finger positioning section 231 can be overlapped with the grabbing section main body 270 and the length dimension in the inserting direction Y of the print finger U1 of the grabbing section main body 270 is enough with the length of the second finger positioning section 232 which positions the thumb. Therefore, the length in the inserting direction Y of the print finger U1 in the nail print apparatus can be made shorter and the entire nail print apparatus can be made smaller and lighter and also the portability is enhanced.

The above embodiments describe an example where printing is simultaneously performed on the nail Ta of the four fingers of one hand and the nail Tb of the thumb of the other hand. However, the grabbing section 20*c* of the present invention can be applied to when printing is performed one finger at a time or one hand at a time.

When printing is performed one finger at a time or one hand at a time, a configuration is possible to perform control so that printing processing starts right after the input of the print start instruction with the print start instruction switch button.

The present invention is not limited to the above embodiments and the embodiments can be suitably modified.

The entire disclosure of Japanese Patent Application No. 2010-275255 filed on Dec. 10, 2010 including specification, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A nail print apparatus comprising:

a print finger inserting section in which a print finger with a nail on which printing is to be performed is to be inserted;

a non-print finger inserting section in which a non-print finger on which printing is not to be performed is to be inserted, the non-print finger inserting section being provided in a position near the print finger inserting section;

a grabbing section which is provided between the print finger inserting section and the non-print finger inserting section and which is configured to be pinched by the print finger inserted in the print finger inserting section and the non-print finger inserted in the non-print finger inserting section, wherein the print finger inserting section is disposed at an upper side of the grabbing section; and a printing section including a print head which applies ink to a nail of the print finger inserted in the print finger inserting section;

wherein the grabbing section includes:

a first finger positioning section which is configured to be pinched by the print finger and the non-print finger of a first hand, which is one of a left hand and a right hand; and a second finger positioning section which is configured to be pinched by the print finger and the non-print finger of a second hand which is the other of the left hand and the right hand;

wherein:

in a state in which the first hand and the second hand are inserted together in the print finger inserting section along a first direction, the print fingers of the first hand and the second hand include (i) at least one specific finger among four fingers including an index finger, a middle finger, a ring finger, and a little finger, of the first hand, and (ii) a thumb of the second hand;

the first finger positioning section includes a first edge section which is configured to contact a base of the print finger and the non-print finger of the first hand;

the second finger positioning section includes a second edge section which is configured to contact a base of the print finger and the non-print finger of the second hand; and the first edge section of the first finger positioning section is provided at a position which is closer to a near side in a hand inserting direction along the first direction than a position at which the second edge section of the second finger positioning section is provided.

2. The nail print apparatus according to claim 1, wherein:

the first finger positioning section is provided on a center section of the grabbing section in a width direction along a second direction orthogonal to the first direction; and the second finger positioning section is provided on both left and right sides of the first finger positioning section in the width direction.

3. The nail print apparatus according to claim 1, wherein the first finger positioning section is formed so that a dimension in a width direction along a second direction orthogonal to the first direction is smaller than a left to right width of the four fingers of the first hand inserted in the print finger inserting section.

4. The nail print apparatus according to claim 1, wherein the second finger positioning section is formed in a curved shape from a planar view so as to fit a base of the thumb of the second hand inserted in the print finger inserting section.

5. The nail print apparatus according to claim 1, wherein the grabbing section includes:

a grabbing section main body which includes the second finger positioning section on both edge sections in a width direction along a second direction orthogonal to the first direction; and a pull out plate which is provided on a center section in the width direction of the grabbing section main body and which is capable of being pulled out from the grabbing section main body toward the near side in the hand inserting direction along the first direction such that at least one portion thereof is separated from the grabbing section main body;

wherein the pull out plate forms the first finger positioning section in a state in which the pull out plate is pulled out from the grabbing section main body.

6. The nail print apparatus according to claim 1, wherein the grabbing section includes:

a grabbing section main body which includes the second finger positioning section on both edge sections in a width direction along a second direction orthogonal to the first direction; and a rotating plate which is configured on an edge section of a center section in the width direction of the grabbing section main body to be rotatable from an extending state extending toward the near side in the hand inserting direction to an overlapping state overlapping with the grabbing section main body, wherein at least one portion of the rotating plate is separated from the grabbing section main body in the extending state;

wherein the rotating plate forms the first finger positioning section in the extending state.

7. The nail print apparatus according to claim 1, further comprising:

a print start instructing section which receives input of a start instruction of printing by the printing section; and a print controlling section which controls the printing section to start printing processing after a predetermined amount of time passes after the print start instruction is input to the print start instructing section.

* * * * *